US006916599B2

(12) United States Patent
Nariyuki

(10) Patent No.: US 6,916,599 B2
(45) Date of Patent: Jul. 12, 2005

(54) PHOTOTHERMOGRAPHIC MATERIAL

(75) Inventor: Fumito Nariyuki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 50 days.

(21) Appl. No.: 10/419,153

(22) Filed: Apr. 21, 2003

(65) Prior Publication Data

US 2003/0224299 A1 Dec. 4, 2003

(30) Foreign Application Priority Data

Apr. 24, 2002 (JP) ..... P.2002-122270

(51) Int. Cl.[7] ..... G03C 1/498; G03C 1/34

(52) U.S. Cl. ..... 430/350; 430/567; 430/607; 430/610; 430/613; 430/619; 430/965

(58) Field of Search ..... 430/619, 567, 430/965, 350, 613, 610, 607

(56) References Cited

U.S. PATENT DOCUMENTS 5,698,380 A * 12/1997 Toya ..... 430/363
6,143,488 A 11/2000 Uytterhoeven et al.
6,770,428 B2 * 8/2004 Maskasky et al. ..... 430/350

FOREIGN PATENT DOCUMENTS

EP 1096310 A2 * 5/2001 ..... G03C/1/498
JP 60-143331 * 12/1983 ..... G03C/1/02

* cited by examiner

*Primary Examiner*—Thorl Chea
(74) *Attorney, Agent, or Firm*—Sughrue Mion, PLLC

(57) ABSTRACT

A photothermographic material comprising: a support; and a photosensitive silver halide, a nonphotosensitive organic silver salt, a reducing agent and a binder, wherein the photosensitive silver halide comprises 90% by mole or more of a silver iodide and has a silver iodobromide structure having an average silver iodide content of 35% by mole or less in vicinity of a surface thereof.

15 Claims, 1 Drawing Sheet

PHOTOTHERMOGRAPHIC MATERIAL

FIELD OF THE INVENTION

The present invention relates to a photothermographic material and a process for producing an image by using the material.

BACKGROUND OF THE INVENTION

In recent years, reduction of amounts of treated waste-water is earnestly demanded in the field of medical services from the standpoint of environment protection and space saving. According thereto, techniques relating to such photosensitive thermal developing photographic materials for medical diagnosis and photographic techniques are required that can be efficiently exposed in a laser image setter or a laser imager to form a sharp black image having high resolution and sharpness. In these photosensitive thermal developing photographic materials, the use of a solvent series treating chemical reagent can be eliminated to provide customers with such a simple thermal developing system that does not impair environments.

While there are the similar demands in the ordinary image forming materials, a medical image has such characteristics that high image quality with excellent sharpness and graininess is demanded owing to minute depiction, and further, a cold tone image is preferred owing to easiness in diagnosis. Under the current circumstances, various kinds of general hardcopy systems utilizing pigments and dyes are commercially available, such as an ink-jet printer and electrophotography, but there is no system that is sufficient as an output system for a medical image.

A thermal image formation system utilizing an organic silver salt is described, for example, in the specifications of U.S. Pat. Nos. 3,152,904 and 3,457,075, and B. Shely, "Thermally Processed Silver Systems", *Imaging Processes and Materials*, Noblette 8th ed., edited by Sturge, V. Walworth and A. Shepp, p. 2 (1996).

In particular, a photothermographic material generally has a photosensitive layer containing a binder matrix having dispersed therein a photocatalyst in a catalytically active amount (such as a silver halide), a reducing agent, a reducible silver halide (such as an organic silver salt), and depending on necessity, a toning agent for controlling the tone of silver. The photothermographic material forms a black silver image through imagewise exposure and heating to a high temperature (such as 80° C. or more) to cause a redox reaction between the silver halide or the reducible silver salt (functioning as an oxidizing agent) and the reducing agent. The redox reaction is accelerated by the catalytic function of a latent image of a silver halide formed by exposure. Therefore, the black silver image is formed in the exposed region. As a medical image forming system utilizing a photothermographic material disclosed in a large number of literatures, such as U.S. Pat. No. 2,910,377 and JP-B-43-4924, Dry Imager FM-DP L has been released by Fuji Medical Systems Inc.

In the production of the thermal image forming system utilizing an organic silver salt, the photothermographic material is produced by two methods, i.e., a method of coating a coating composition containing a solution formed by dissolving a polymer of a main binder in an organic solvent, followed by drying, and a method of coating a coating composition containing polymer fine particles of a main binder as an aqueous dispersion, followed by drying. The production equipment for the later method is simple since a recovering step of a solvent is not necessary, and thus the method is advantageous for mass production.

The thermal image forming system utilizing an organic silver salt has a severe problem in storage stability of an image after developing treatment, particularly deterioration of a printout upon irradiation with light, due to the absence of a fixing step. As a method for improving the printout, a method of utilizing AgI formed by converting an organic silver salt is disclosed in U.S. Pat. No. 6,143,488 and EP 0,922,995. However, the methods of converting an organic silver salt with iodine as disclosed herein cannot provide sufficient sensitivity to fail to build a practical system.

Other examples of sensitive materials utilizing AgI are disclosed in WO97/48014, WO97/48015, U.S. Pat. No. 6,165,705, JP-A-8-297345 and Japanese Patent No. 2,785,129, but they fail to attain the sufficient sensitivity/fogging level and cannot be applied to practical use. A method for utilizing a silver halide having a large silver iodide content is being demanded.

JP-A-2000-305213 discloses an image forming process and a photosensitive material utilizing blue to ultraviolet laser light as an exposure light source, but AgI is not used therein, and the sensitivity thereof is insufficient.

SUMMARY OF THE INVENTION

As a result of earnest investigations made by the inventors for developing a method for utilizing a silver halide having a large silver iodide content, it has been found that a photosensitive material with high sensitivity and high image quality can be obtained by using AgI in a system using blue to ultraviolet laser light. However, an expected sensitivity cannot be obtained only with AgI, but there is such a problem of causing a large desensitization width with increase of the polyhalogen amount.

In view of the foregoing problem, an object of the invention is to provide a photothermographic material that uses a silver halide having a high silver iodide content, has high sensitivity, and exhibits a small desensitization width due to a polyhalogen amount, and to provide a process for forming an image using the material.

The object of the invention has been accomplished by the following photothermographic materials.

1. A photothermographic material containing a support having thereon at least a photosensitive silver halide, a nonphotosensitive organic silver salt, a reducing agent and a binder, the photosensitive silver halide having a total silver iodide content of 90% by mole or more and having a silver iodobromide structure having an average silver iodide content of 35% by mole or less in vicinity of a surface thereof.

2. A photo thermographic material described in the item 1, wherein the photothermographic material contains a compound represented by the following formula (1) on a surface of the support, on which the photosensitive silver halide is contained, in an amount of 0.2 mole or more per 1 mole of the photosensitive silver halide:

(1)

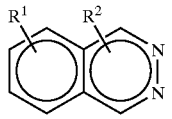

wherein $R^1$ and $R^2$ each independently represents a hydrogen atom or a group that can be substituted on a benzene ring.

3. A photothermographic material described in the item 1 or 2, wherein the photosensitive silver halide is formed under a state where the nonphotosensitive organic silver salt is not present.

4. A photothermographic material described in one of the items 1 to 3, wherein the photothermographic material contains a compound represented by the formula (1) on a surface of the support, on which the photosensitive silver halide is contained, in an amount of 0.5 mole or more per 1 mole of the photosensitive silver halide.

5. A process for forming an image containing a step of exposing a photothermographic material described in one of the items 1 to 4 by using a laser light source having a light emission peak at a wavelength of from 350 to 450 nm.

6. A process for forming an image containing a step of exposing a photothermographic material described in one of the items 1 to 4 by using a laser light source having a light emission peak at a wavelength of from 390 to 430 nm.

7. A process for forming an image as described in the item 5 or 6, wherein the laser light has an exposure illuminance of 1 $mW/mm^2$ or more and an exposure time of 1 second or less.

It is important that the photosensitive silver halide used in the invention is a silver halide having a high silver iodide content having a total silver iodide content of 90% by mole or more and having a silver iodobromide structure having an average silver iodide content of 35% by mole or less in vicinity of a surface thereof.

It is preferred that the photosensitive silver halide used in the invention has, in at least part thereof, a phase absorbing light through direct transition. It has been well known in the art that a silver halide realizes absorption through direct transition at an exposure wavelength of from 350 to 450 nm with a high silver iodide structure having a hexagonal wurtzite structure or a cubic zincblende structure. However, a silver halide having a high silver iodide content is generally has low sensitivity and low utility value, and thus, the silver halide having the crystalline structure attaining the absorption through direct transition also generally has low sensitivity and low utility value in the field of photographic industry.

According to the studies made by the inventors, it has been found that in a photothermographic material containing a nonphotosensitive organic silver halide and a reducing agent, such a photosensitive material having a high silver iodide content attains high sensitivity and high sharpness by exposure of a large illuminance (1 $mW/mm^2$ or more) for a short period of time (1 second or less, preferably $10^{-2}$ second or less, and more preferably $10^{-4}$ second or less).

It has been also found that the photosensitive silver halide having a silver iodobromide structure in vicinity of a surface thereof can attain further high sensitivity while the image stability after processing is maintained, in comparison to those having no silver iodobromide structure.

According to the finding by the inventors, it is preferred that the size of the silver halide herein is 80 nm or less. The effect of the invention is particularly clearly exerted with a silver halide with a small particle size.

Figure 1:
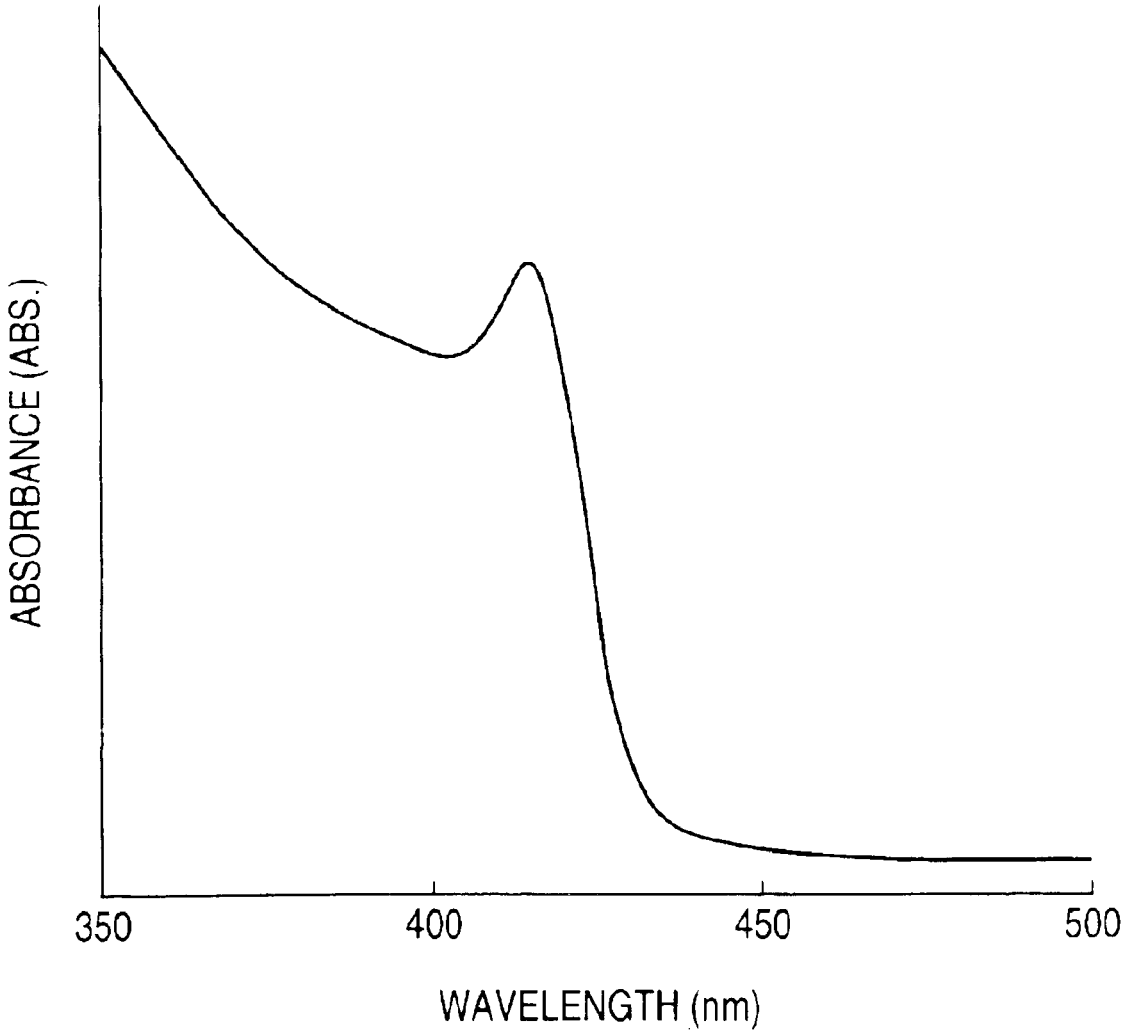
[FIG. 1]

It is a diagram showing light absorption of a silver iodide emulsion that is preferably used in the invention.

DETAILED DESCRIPTION OF THE INVENTION

Elements constituting the photothermographic material of the invention will be described in detail below.

The photosensitive silver halide of the invention preferably has a total silver iodide content of 90% by mole or more. It is more preferred that the photosensitive silver halide has a total silver iodide content of from 95 to 98% by mole.

The silver halide of the invention preferably exhibits direct transition absorption ascribed to the silver iodide crystalline structure at a wavelength of from 350 to 450 nm. It can be conveniently discriminated as to whether or not a silver halide has light absorption through direct transition by observing exciton absorption ascribed to direct transition around a wavelength of from 400 to 430 nm.

FIG. 1 shows light absorption of a silver iodide emulsion that is preferably used in the invention. It is found that absorption ascribed to a high silver iodide exciton around 420 nm.

The direct transition light absorption high silver iodide phase may be present solely, but it is preferably present through junction with a silver halide exhibiting indirect transition in a wavelength range of from 350 to 450 nm, such as silver bromide, silver chloride, silver iodobromide, silver iodochloride and mixed crystals thereof.

The silver halide phase absorbing light through direct transition generally exhibits strong light absorption, but it has low sensitivity in comparison to an indirect transition silver halide phase exhibiting only weak absorption and has not been industrially utilized.

In the invention, preferred sensitivity can be obtained by exposing a high silver iodide photosensitive material having a silver iodobromide structure in vicinity of a surface thereof at an exposure wavelength of from 350 to 450 nm.

The wavelength for exposure is more preferably from 370 to 430 nm, further preferably from 390 to 430 nm, and particularly preferably from 390 to 420 nm.

The photosensitive silver halide of the invention exerts further preferred characteristics when it has a particle size of from 5 to 80 nm. The silver halide particles having the phase attaining direct transition absorption exhibits sufficient sensitivity when they have a small particle size of 80 nm or less.

The particle size of the photosensitive silver halide is more preferably from 5 to 60 nm, and further preferably from 10 to 50 nm. The particle size referred herein means a converted diameter of spheres having the same volume as the volume of the silver halide particles.

The formation process of a silver halide has been well known in the art, and for example, methods described in *Research Disclosure*, No. 17029 (June of 1978) and U.S. Pat. No. 3,700,458. Specifically, such a method can be used that a silver supplying compound and a halogen supplying compound are added to a solution of a polymer, such as gelatin, to prepare a photosensitive silver halide, which is then mixed with an organic silver salt. Methods described in paragraphs 0217 to 0224 of JP-A-11-119374, Japanese Patent Application No. Hei 11-98708 and JP-A-2000-347335 are also preferred.

Examples of the shape of the silver halide particles include cubic particles, octahedral particles, dodecahedral particles, tetradecahedral particles, tabular particles, spherical particles, columnar particles and irregular shape particles, and cubic particles are particularly preferred in the invention. Silver halide particles having rounded corners can also be preferably used.

The silver halide particles of the invention is characterized by having a silver iodobromide structure having an average silver iodide content of 35% by mole or less in the vicinity of the surface. The average silver iodide content of the silver iodobromide structure in the vicinity of the surface is preferably 25% by mole or less, and more preferably 15% by mole or less.

In order to impart the silver iodobromide structure in the vicinity of the surface, a preparation method of core/shell particles can be employed, in which the interior of particles (core) is silver iodobromide, and the exterior thereof (shell) is silver bromide. A silver halide emulsion having a dual structure can be prepared with reference to JP-A-60-143331. In order to produce the high silver iodide particles having a silver iodobromide structure in the vicinity of the surface, such a method is employed in that a silver ion and a bromide ion are supplied in the form of a silver salt aqueous solution and a bromide aqueous solution to silver iodide host particles in a reactor. Silver bromide is grown as silver iodobromide while dissolving silver iodide to produce the silver iodobromide structure in the vicinity of the surface.

The vicinity of the surface referred in the invention means a region by a depth of about 5 nm from the surface. The composition of the region can be measured by such a surface analysis method as XPS (X-ray photoelectric spectroscopy) or ISS (ionic scattering spectroscopy).

The composition can also be confirmed by an X-ray diffraction method, and the average composition of the silver iodobromide structure and the ratio between the pure silver iodide part and the silver iodobromide part can also be measured.

In the invention, silver halide particles having a hexacyano metallic complex present on the outermost surface of the particles are preferred. Examples of the hexacyano metallic complex include $[Fe(CN)_6]^{4-}$, $[Fe(CN)_6]^{3-}$, $[Ru(CN)_6]^{3-}$, $[Os(CN)_6]^{4-}$, $[Co(CN)_6]^{3-}$, $[Rh(CN)_6]^{3-}$, $[Ir(CH)_6]^{3-}$, $[Cr(CN)_6]^{3-}$ and $[Re(CN)_6]^{3-}$. In the invention a hexacyano Fe complex is preferred.

With respect to the hexacyano metallic complex, a counter anion is not important since it is present in the form of an ion in an aqueous solution, and it is preferably those suitable for a precipitation operation of a silver halide emulsion, such as an alkali metallic ion, e.g., a sodium ion, a potassium ion, a rubidium ion, a cesium ion and a lithium ion, an ammonium ion, and an alkylammonium ion (e.g., a tetramethylammonium ion, a tetraethylammonium ion, a tetrapropyammonium ion and a tetra(n-butyl)ammonium ion).

The hexacyano metallic complex may be added after mixing with a mixed solvent with a suitable organic solvent that can be mixed with water (such as an alcohol, an ether, a glycol, a ketone, an ester and an amide) or gelatin.

The addition amount of the hexacyano metallic complex is preferably from $1\times10^{-5}$ to $1\times10^{-2}$ mole, and more preferably from $1\times10^{-4}$ to $1\times10^{-3}$ mole, per 1 mole of silver.

In order to make the hexacyano metallic complex present on the outermost surface of the silver halide particles, the hexacyano metallic complex is directly added before completing the charging step, during the water washing step, during the dispersing step or before the chemical sensitizing step, which is after completing the addition of a silver nitrate aqueous solution used for forming the particles and before the chemical sensitizing step, in which chalcogen sensitization, such as sulfur sensitization, selenium sensitization and tellurium sensitization, or a noble metal sensitization, such as gold sensitization, is carried out. In order to prevent the silver halide particles from growing, it is preferred that the hexacyano metallic complex is added immediately after forming the particles, and it is also preferred that it is added before completing the charging step.

It is preferred that the addition of the hexacyano metallic complex is stated at the time when 96% by weight of the total amount of silver nitrate added for forming the particles has been added, more preferably at the time when 98% by weight thereof has been added, and particularly preferably at the time when 99% by weight thereof has been added.

When the hexacyano metallic complex is added immediately before completing the particle formation and after the addition of the silver nitrate aqueous solution, it can be adsorbed on the outermost surface of the silver halide particles, and almost all thereof forms a difficultly soluble salt with a silver ion on the surface of the particles. Because the silver salt of hexacyano iron(II) is more difficultly soluble than AgI, re-dissolution by fine particles can be prevented, and the silver halide fine particles of the invention having a small particle size can be produced.

The photosensitive silver halide particles of the invention may contain a metal or a metallic complex of Group 8 to Group 10 in the periodic table (showing from Group 1 to Group 18).

The metal or a central metal of the metallic complex of Group 8 to Group 10 is preferably rhodium, ruthenium and iridium. The metallic complex may be used solely, or two or more kinds of complexes of the same metal or different metals may be used in combination.

The content thereof is preferably in a range of from $1\times10^{-9}$ to $1\times10^{-3}$ mole per 1 mole of silver.

The heavy metal, the metallic complex and the method for adding them are described in JP-A-7-225449, paragraphs 0018 to 0024 of JP-A-11-65021 and paragraphs 0227 to 0240 of JP-A-11-119374.

A metallic atom that can be contained in the silver halide particles used in the invention (such as $[Fe(CH)_6]^{4-}$), a desalting method of the silver halide emulsion and a chemical sensitizing method are described in paragraphs 0046 to 0050 of JP-A-11-84574, paragraphs 0025 to 0031 of JP-A-11-65021 and paragraphs 0242 to 0250 of JP-A-11-119374.

As gelatin contained in the photosensitive silver halide emulsion used in the invention, various kinds of gelatin may be used. In order to maintain good dispersion conditions of the photosensitive silver halide emulsion in a coating composition containing an organic silver salt, low molecular weight gelatin having a molecular weight of from 500 to 60,000 is preferably used. The low molecular weight gelatin may be used upon forming the particles or upon dispersion after the desalting treatment, and it is used upon dispersion after the desalting treatment.

Various kinds of compounds that have been known as a chromatic sensitizer may be used in the invention to increase the inherent sensitivity. Examples of the compounds used in the invention include those disclosed in EP-A-587,338, U.S. Pat. Nos. 3,877,943 and 4,873,184, JP-A-5-341432, JP-A-11-109547 and JP-A-10-111543.

The photosensitive silver halide particles in the invention are preferably chemically sensitized by a sulfur sensitizing method, a selenium sensitizing method or a tellurium sensitizing method. Examples of the compound used in a sulfur sensitizing method, a selenium sensitizing method or a tellurium sensitizing method include the known compounds, such as those disclosed in JP-A-7-128768.

In particular, a tellurium sensitization is preferred in the invention, and the compounds disclosed in paragraph 0030 of JP-A-11-65021 and the compounds represented by the formulae (II), (III) and (IV) in JP-A-5-313284 are more preferred.

In the invention, the chemical sensitization may be carried out at any timing after forming the particles before coating, and examples of the timing include (1) before the spectral sensitization, (2) simultaneously with the spectral sensitization, (3) after the spectral sensitization and (4) immediately before coating. It is particularly preferably carried out after the spectral sensitization.

The using amount of a sulfur, selenium or tellurium sensitizer used in the invention is generally from $10^{-8}$ to $10^{-2}$ mole, and preferably from $10^{-7}$ to $10^{-3}$ mole, per mole of silver halide while it varies depending on the silver halide particles and the chemical aging conditions used. While the conditions of the chemical sensitization in the invention are not particularly limited, the pH may be from 5 to 8, the pAg may be from 6 to 11, and the temperature may be about from 40 to 95° C.

A thiosulfonic acid compound may be added to the silver halide emulsion used in the invention according to the method shown in EP-A-293,917.

The photosensitive silver halide emulsion in the photosensitive material used in the invention may be used solely, or two or more kinds thereof (for example, those having different average particle diameters, those having different halogen compositions, those having different crystal habits and those having different chemical sensitization conditions) may be used in combination. The gradation can be adjusted by using plural kinds of photosensitive silver halide having different sensitivities.

Examples of the techniques relating to these constitutions include those disclosed in JP-A-57-119341, JP-A-53-106125, JP-A-47-3929, JP-A-48-55730, JP-A-46-5187, JP-A-50-73627 and JP-A-57-150841. It is preferred that the emulsions have a difference in sensitivity of 0.2 logE among the emulsions.

The addition amount of the photosensitive silver halide in terms of a coated silver amount per 1 $m^2$ of the photosensitive material is preferably from 0.03 to 0.6 $g/m^2$, more preferably from 0.07 to 0.4 $g/m^2$, and most preferably from 0.05 to 0.3 $g/m^2$, and the addition amount of the photosensitive silver halide in terms of an amount per 1 mole of the organic silver salt is preferably from 0.01 to 0.3 mole, more preferably from 0.02 to 0.2 mole, and further preferably from 0.03 to 0.15 mole.

Examples of the mixing method and the mixing conditions of the photosensitive silver halide and the organic silver salt, which have been separately prepared, include such a method that the silver halide particles and the organic silver salt having been prepared are mixed, for example, in a high-speed agitator, a ball mill, a sand mill, a colloid mill, a vibration mill or a homogenizer, and such a method that the photosensitive silver halide having been prepared is mixed with the organic silver salt at certain timing during preparation, followed by completing the preparation of the organic silver salt.

As having been noted, it is preferred that the silver halide of the invention is preferably formed under a state where the organic silver salt is not present. Such a method is also preferred that two or more kinds of the organic silver salt aqueous dispersions and two or more kinds of the photosensitive silver salt aqueous dispersions are mixed from the standpoint of adjustment of the photographic characteristics.

The timing of adding the silver halide of the invention to a coating composition for forming an image forming layer is preferably 180 minutes before coating to immediately before coating, and more preferably 60 minutes before coating to 10 seconds before coating, but the mixing method and the mixing conditions are not particularly limited as far as the effect of the invention is sufficiently exerted.

Specific examples of the mixing method include a method using a tank that designates a desired mean residence time calculated from the addition flow rate and the supplying rate to a coater, and a method using a static mixer disclosed in N. Harnby, M. F. Edwards and A. W. Nienow (translated by K. Takahashi), *Ekitai Kongo Gijutu* (Liquid Mixing Techniques), Chapter 8, published by Nikkan Kogyo Shimbun Co., Ltd. (1989).

The gradation of the photosensitive material may be arbitrarily determined, and it is preferred that the average contrast in a density range of from 1.5 to 3.0 is from 1.5 to 10 for effective manifestation of the effect of the invention.

The average contrast referred herein means the gradient of a line passing an optical density of 1.5 and an optical density of 3.0 in a characteristic curve, in which the abscissa is logarithm of an exposure amount of laser, and the ordinate is an optical density of a photosensitive material after thermal development exposed at the exposure amount.

The average contrast is preferably from 1.5 to 10 for the improvement in performance of sharpness of characters. It is more preferably from 2.0 to 7, and further preferably from 2.5 to 6.

A toning agent used in the photothermographic material of the invention will be described.

The toning agent is described in paragraphs 0054 to 0055 of JP-A-10-62899, page, 21, lines 23 to 48 of EP 0,803764A1, JP-A-2000-356317 and Japanese Patent Application No. 2000-187298. Preferred examples thereof include a phthalazinone compound (such as phthalazinone and a phthalazinone derivative or a metallic salt thereof, e.g., 4-(1-naphtyl)phthalazinone, 6-chlorophthalazinone, 5,7-dimethoxyphthalazinone and 2,3-dihydro-1,4-phthalazindione); a combination of a phthalazinone compound and a phthalic acid compound (such as phthalic acid, 4-methylphthalic acid, 4-nitrophthalic acid, diammonium phthalate, sodium phthalate, potassium phthalate and tetrachlorophthalic anhydride); a phthalazine compound (such as phthalazine and a phthalazine derivative or a metallic salt thereof, e.g., 4-(1-naphthyl)phthalazine, 6-isopropylphthalazine, 6-t-butylphthalazine, 6-chlorophthalazine, 5,7-dimethoxyphthalazine and 2,3-dihydrophthalazine); and a combination of a phthalazine compound and a phthalic acid compound, and the combination of a phthalazine compound and a phthalic acid compound is particularly preferred.

As the toning agent of the invention, a compound represented by the formula (1) is preferred.

In the formula (1), $R^1$ and $R^2$ each independently represents a hydrogen atom or a group that can be substituted on a benzene ring.

Examples of the group that can be substituted on a benzene ring in $R^1$ and $R^2$ include an alkyl group, an aryl group, a halogen atom, a hydroxyl group and an alkoxy group. Specific examples of the group that can be substituted include a methyl group, an ethyl group, an isopropyl group, an isobutyl group, a t-butyl group, a chlorine atom, a methoxy group and a hydroxyl group.

Specific examples of the compound represented by the formula (1) include 6-isopropylphthalazine, 6-t-butylphthalazine, 5-chlorophthalazine, 5,7-dimethoxyphthalazine and 2,3-dihydrophthalazine, and 6-isoprpylphthalazine is particularly preferred.

The addition amount of the toning agent in the invention is preferably 0.2 mole or more, more preferably 0.5 mole or more, and further preferably 1 mole or more, per 1 mole of the photosensitive silver halide.

The toning agent is preferably a combination with a phthalic acid compound. Particularly preferred combinations include a combination of 6-isopropylphthalazine and phthalic acid or 4-methylphthalic acid.

The organic silver salt that can be used in the invention is such a silver salt that is relatively stable to light but forms a silver image upon heating to a temperature of 80° C. or more in the presence of an exposed photocatalyst (such as a latent image of a photosensitive silver halide) and a reducing agent. The organic silver salt may be an arbitrary organic substance containing a source capable of reducing a silver ion.

The nonphotosensitive organic silver salt is described in paragraphs 0048 to 0049 of JP-A-10-62899, page 18, line 24 to page 19, line 37 of EP 0.803,764A1, EP 0,962,812A1, JP-A-11-349591, JP-A-2000-7683 and JP-A-2000-72711.

The organic silver salt in the invention is preferably a silver salt of an organic acid, particularly a silver salt of a long chain aliphatic carboxylic acid (having from 10 to 30, preferably from 15 to 28, carbon atoms). Preferred examples of the aliphatic acid silver salt include silver behenate, silver arachidinate, silver stearate, silver oleate, silver laurate, silver caproate, silver myristate, silver palmitate and a mixture thereof.

Among these aliphatic acid silver salts, it is preferred in the invention to use an aliphatic acid silver salt having a content of silver behenate of 50% by mole or more, more preferably 80% by mole or more, and further preferably 90% by mole or more.

The shape of the organic silver salt that can be used in the invention is not particularly limited and may be an acicular shape, a rod shape, a tabular shape or a squamous shape.

An organic salt having a squamous shape is preferably used in the invention. An organic salt having a short acicular shape having a ratio of the major axis and the minor axis of 5 or less, a rectangular parallelepipedal shape, a cubic shape or an irregular shape is also preferably used. These organic silver salt particles have such characteristics that they suffer small fogging on thermal development in comparison to long acicular particles having a ratio of the major axis and the minor axis of 5 or more.

The organic silver salt having a squamous shape in the invention is defined as follows. The organic silver salt is observed with an electron microscope, and the shape of the organic silver salt particle is approximated as a rectangular parallelepiped. The edges of the rectangular parallelepiped is designated as a, b and c in the order from the shortest edges to the longest edges (in which c may be the same as b), and the value x is calculated from a and b according to the following equation.

$$x=b/a$$

The value x is obtained for about 200 particles, and the average value thereof is designated as x (average). The particles satisfying the condition x (average)$\geqq$1.5 are designated as those having a squamous shape. The value x (average) preferably satisfies the condition 30$\geqq$x (average)$\geqq$1.5, and more preferably 20$\geqq$x (average)$\geqq$2.0. The acicular shape is designated by the condition 1.5$\geqq$x (average)$\geqq$1.

In the squamous particles, the value a can be understood as a thickness of a tabular particle having a plane with edges b and c as a principal plane. The average value of a is preferably from 0.01 to 0.23 $\mu$m, and more preferably from 0.1 to 0.20 $\mu$m. The average value of c/b is preferably 1 to 6, more preferably from 1.05 to 4, further preferably from 1.1 to 3, and particularly preferably from 1.1 to 2.

The particle size distribution of the organic silver salt is preferably monodisperse. The term monodisperse herein means that a percentage of a value obtained by dividing the standard deviations of the minor axis and the major axis by the minor axis and the major axis, respectively, is 100% or less, more preferably 80% or less, and further preferably 50% or less. The shape of the organic silver salt can be measured from a transmission electron micrograph of the organic silver salt dispersion.

Another method for measuring the monodispersity includes a method of obtaining a standard deviation of the volume weighted average diameter of the organic silver salt, and the percentage of a value obtained by dividing by the volume weighted average diameter (variation coefficient) is preferably 100% or less, more preferably 80% or less, and further preferably 50% or less. The measurement method therefor includes such a method that the organic silver salt dispersed in a liquid is irradiated with laser light, and an autocorrelation function with respect to time of the fluctuation of the scattered light therefrom is measured to obtain the particle size (volume weighted average diameter).

The production method and the dispersion method of the organic silver salt used in the invention can be carried out according to the ordinary methods Examples thereof include those described in JP-A-10-62899, EP0,803,763A1, EP 0,962,812A1, JP-A-11-349591, JP-A-2000-7683, JP-A-2000-72711, JP-A-11-348228, JP-A-11-348229, JP-A-11-348230, JP-A-11-203413, and Japanese Patent Application Nos. 2000-90093, 2000-195621, 2000-191226, 2000-213813, 2000-214155 and 2000-191226.

In the case where the photosensitive silver salt is present upon dispersing the organic silver salt, the fogging is increased to lower the sensitivity in a considerable extent, and therefore, it is preferred that the photosensitive silver halide is substantially not contained upon dispersing.

The amount of the photosensitive silver salt in an aqueous dispersion to be dispersed is preferably 1% by mole or less per 1 mole of the silver halide in the dispersion, more preferably 0.1% by mole, and further preferably no positive addition of the photosensitive silver salt.

In the invention, the photosensitive material can be produced by mixing the organic silver salt aqueous dispersion and the photosensitive silver salt aqueous dispersion. The mixing ratio of the organic silver salt and the photosensitive silver salt may be selected depending on purposes, and the ratio of the photosensitive silver halide to the organic silver salt is preferably in a range of from 1 to 30% by mole, more preferably from 2 to 20% by mole, and particularly preferably from 3 to 15% by mole.

Such a method is also preferred that two or more kinds of the organic silver salt aqueous dispersions and two or more kinds of the photosensitive silver salt aqueous dispersions are mixed from the standpoint of adjustment of the photographic characteristics.

The organic silver salt of the invention can be used in a desired amount, and the amount thereof in terms of silver is preferably from 0.1 to 5 g/m$^2$, more preferably from 0.3 to 3 g/m$^2$, and further preferably from 0.5 to 2 g/m$^2$.

The photothermographic material of the invention preferably contains a thermal developer as a reducing agent for the organic silver salt. The reducing agent for the organic silver salt may be an arbitrary substance (preferably an organic substance) capable of reducing a silver ion to metallic silver.

Examples of the reducing agent are disclosed in paragraphs 0043 to 0045 of JP-A-11-65021 and page 7, line 34 to page 18, line 12 of EP 0,803,764A1.

In the invention, the reducing agent is preferably a so-called hindered phenol reducing agent having a substituent at an ortho position of a phenolic hydroxyl group or a bisphenol reducing agent, and more preferably a compound represented by the following formula (R):

(R)

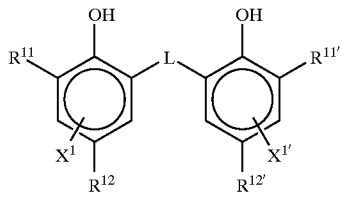

wherein $R^{11}$ and $R^{11'}$ each independently represents an alkyl group having from 1 to 20 carbon atoms; $R^{12}$ and $R^{12'}$ each independently represents a hydrogen atom or a group that can be substituted on a benzene ring; L represents an —S— group or a —$CHR^{13}$— group; $R^{13}$ represents a hydrogen atom or an alkyl group having from 1 to 20 carbon atoms; $X^1$ and $X^{1'}$ each independently represents a hydrogen atom or a group that can be substituted on a benzene ring.

The formula (R) will be described in detail.

$R^{11}$ and $R^{11'}$ each independently represents a substituted or unsubstituted alkyl group having from 1 to 20 carbon atoms. The substituent on the alkyl group is not particularly limited, and preferred examples thereof include an aryl group, a hydroxyl group, an alkoxy group, an aryloxy group, an alkylthio group, an arylthio group, an acyl amino group, a sulfon amide group, a sulfonyl group, a phosphoryl group, an acyl group, a carbamoyl group, an ester group, a ureido group, a urethane group and a halogen atom.

$R^{12}$ and $R^{12'}$ each independently represents a hydrogen atom or a group that can be substituted on a benzene ring, and $X^1$ and $X^{1'}$ also each independently represents a hydrogen atom or a group that can be substituted on a benzene ring. Preferred examples of the group that can be substituted on a benzene ring include an alkyl group, an aryl group, a halogen atom, an alkoxy group and an acylamino group.

L represents an —S— group or a —$CHR^{13}$ group. $R^{13}$ represents a hydrogen atom or an alkyl group having from 1 to 20 carbon atoms, and the alkyl group may have a substituent. Specific examples of the unsubstituted alkyl group represented by $R^{13}$ include a methyl group, an ethyl group, a propyl group, a butyl group, a heptyl group, an undecyl group, an isopropyl group, a 1-ethylpentyl group and a 2,4,4-trimethylpentyl group. Examples of the substituent on the alkyl group include those exemplified for the substituent of $R^{11}$.

$R^{11}$ and $R^{11'}$ preferably represents a secondary or tertiary alkyl group having from 3 to 15 carbon atoms, and specific examples thereof include an isopropyl group, an isobutyl group, a t-butyl group, a t-amyl group, a t-octyl group, a cyclohexyl group, a cyclopentyl group, a 1-methylcyclohexyl group and a 1-methylcyclopropyl group.

$R^{11}$ and $R^{11'}$ more preferably represents a tertiary alkyl group having from 4 to 12 carbon atoms, and a t-butyl group, a t-amyl group and a 1-methylcyclohexyl group are further preferred among them with a t-butyl group being most preferred.

$R^{12}$ and $R^{12'}$ each preferably represents an alkyl group having from 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group. More preferred examples thereof include a methyl group, an ethyl group, a propyl group, an isopropyl group and a t-butyl group.

$X^1$ and $X^{1'}$ each preferably represents a hydrogen atom, a halogen atom or an alkyl group, and more preferably represents a hydrogen atom.

L preferably represents a —$CHR^{13}$— group.

$R^{13}$ preferably represents a hydrogen atom or an alkyl group having from 1 to 15 carbon atoms, and preferred examples of the alkyl group include a methyl group, an ethyl group, a propyl group, an isopropyl group and a 2,4,4-trimethylpentyl group. Particularly preferred examples of $R^{13}$ include a hydrogen atom, a methyl group, an ethyl group, a propyl group and an isopropyl group.

In the case where R13 represents a hydrogen atom, $R^{12}$ and $R^{12'}$ each preferably represents an alkyl group having from 2 to 5 carbon atoms, more preferably an ethyl group or a propyl group, and most preferably an ethyl group.

In the case where $R^{13}$ represents a primary or secondary alkyl group having from 1 to 8 carbon atoms, $R^{12}$ and $R^{12'}$ each preferably represents a methyl group. Preferred examples of the primary or secondary alkyl group having from 1 to 8 carbon atoms of $R^{13}$ include a methyl group, an ethyl group, a propyl group and an isopropyl group, and a methyl group, an ethyl group and a propyl group are more preferred.

In the case where all $R^{11}$, $R^{11'}$, $R^{12}$ and $R^{12'}$ represent methyl groups, $R^{13}$preferably represents a secondary alkyl group. Examples of the secondary alkyl group of $R^{13}$ in this case include an isopropyl group, an isobutyl group and a 1-ethylpentyl group, and an isopropyl group is more preferred.

The reducing agent varies in thermal developing property and developed silver tone depending on the combination of $R^{11}$, $R^{11'}$, $R^{12}$, $R^{12'}$ and $R^{13}$. The properties can be adjusted by combining two or more kinds of the reducing agents, and therefore, it is preferred that two or more kinds of the reducing agents are used in combination depending on purpose.

Specific examples of the reducing agent of the invention including the compounds represented by the formula (R) will be described below, but the invention is not construed as being limited thereto.

(I-1)

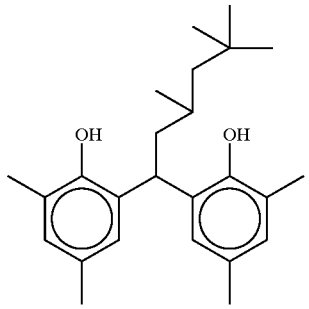

-continued
(I-2)
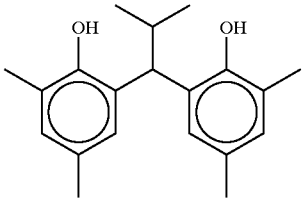
(I-3)
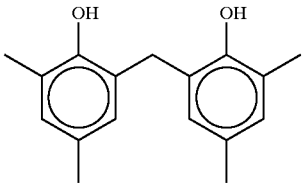
(I-4)
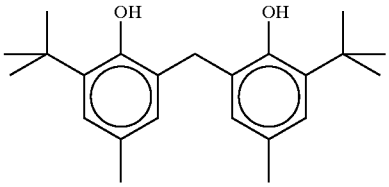
(I-5)
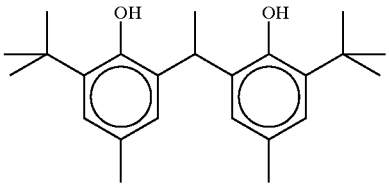
(I-6)
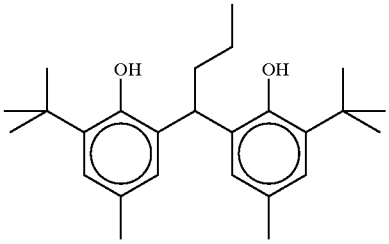
(I-7)
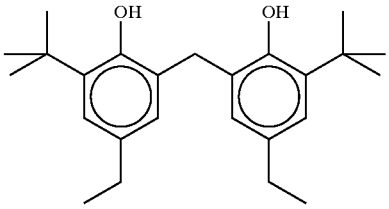
(I-8)
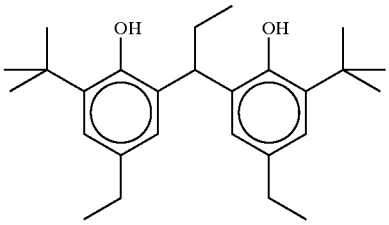
-continued
(I-9)
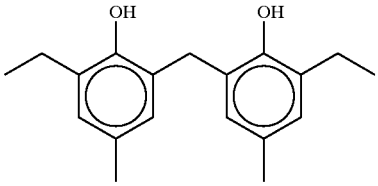
(I-10)
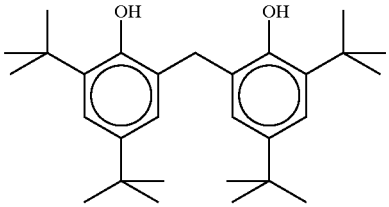
(I-11)
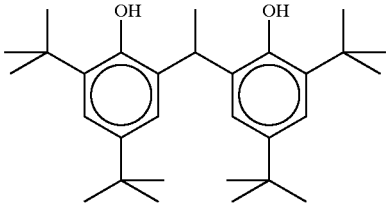
(I-12)
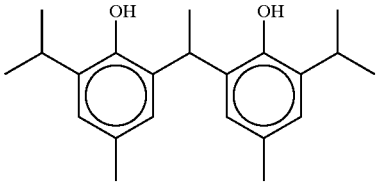
(I-13)
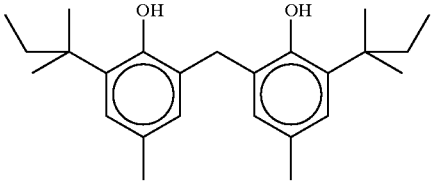
(I-14)
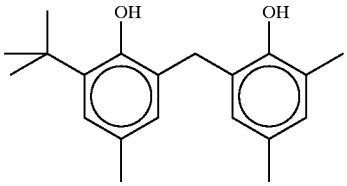
(I-15)
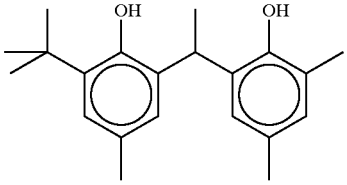
(I-16)
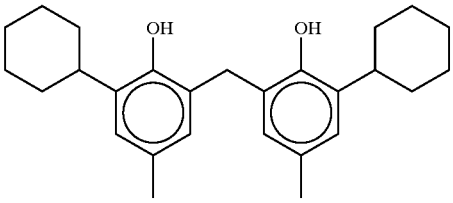

-continued
(I-17)
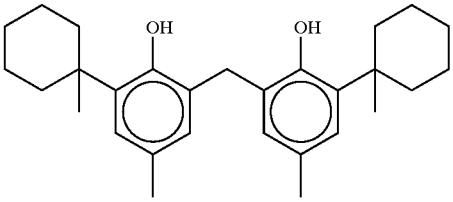
(I-18)
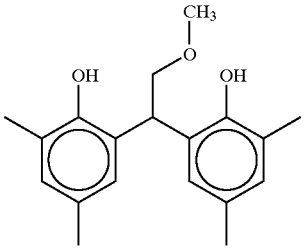
(I-19)
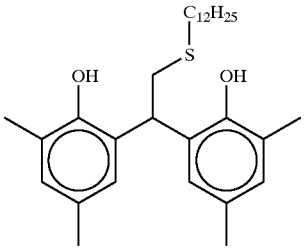
(I-20)
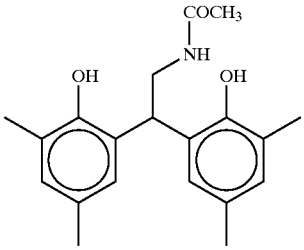
(I-21)
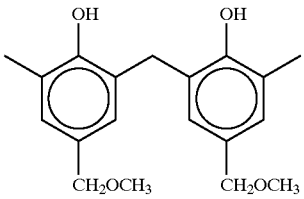
(I-22)
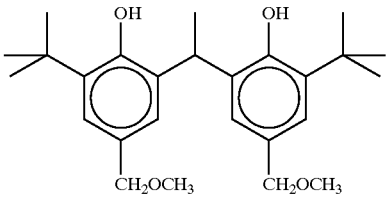
-continued
(I-23)
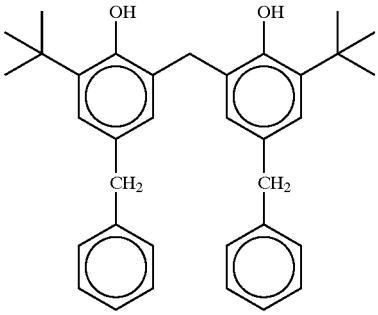
(I-24)
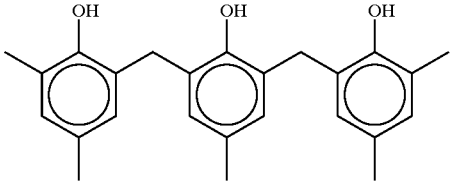
(I-25)
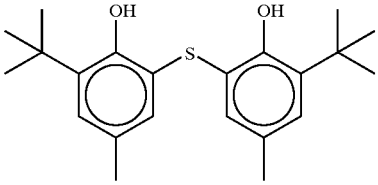
(I-26)
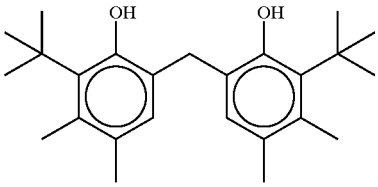
(I-27)
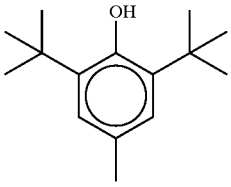
(I-28)
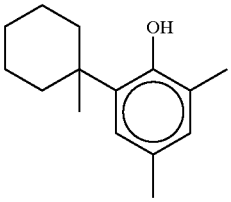
(I-29)
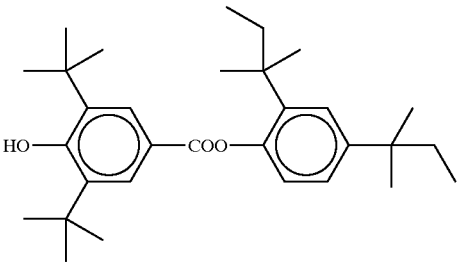

-continued (I-30)

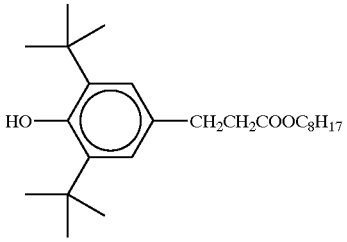

(I-31)

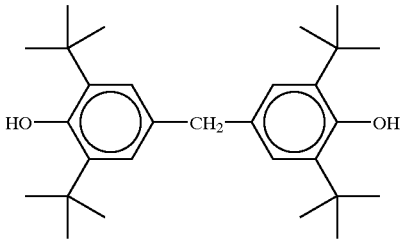

(I-32)

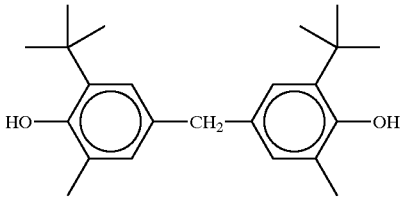

(I-33)

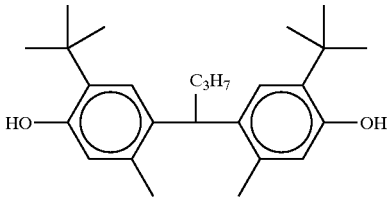

(I-34)

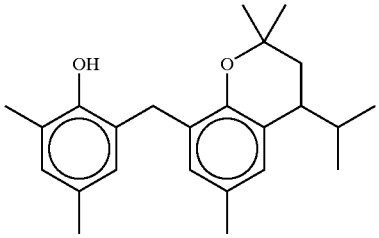

The addition amount of the reducing agent in the invention is preferably from 0.1 to 3.0 g/m$^2$, more preferably from 0.2 to 1.5 g/m$^2$, and further preferably from 0.3 to 1.0 g/m$^2$.

It is preferably contained in an amount of from 5 to 50% by mole per 1 mole of silver on the surface, on which the image forming layer is formed, more preferably from 8 to 30% by mole, and further preferably from 10 to 20% by mole. It is preferably contained in the image forming layer.

The reducing agent may be contained in a coating composition in any form and any method, e.g., in the form of a solution, an emulsion dispersion or a solid fine particle dispersion, to be contained in the photosensitive material.

Examples of the well-known method therefor include a method, in which it is dissolved by using an auxiliary solvent, such as an oil, e.g., dibutyl phthalate, tricresyl phosphate, glyceril triacetate and diethyl phthalate, ethyl acetate and cyclohexanone, and an emulsion dispersion is mechanically produced.

Examples of the solid fine particle dispersion method include such a method in that powder of the reducing agent is dispersed in a suitable solvent, such as water, with a ball mill, a colloid mill, a vibration ball mill, a sand mill, a jet mill, a roller mill or ultrasonic wave, so as to form a solid dispersion. A protective colloid (such as polyvinyl alcohol) and a surface active agent (such as an anionic surface active agent, e.g., sodium triisopropylnaphthalenesulfonate (a mixture of isomers with different substitution positions of the three isopropyl groups)) may be used herein. Beads, such as zirconia, are generally used as a dispersing medium in the foregoing mills, and therefore, Zr or the like substance is eluted from the beads into the dispersion. The amount thereof is generally in a range of from 1 to 1,000 ppm while it depends on the dispersion conditions. There is no practical problem when the content of Zr in the photosensitive material is 0.5 mg or less per 1 g of silver.

It is preferred that an antiseptic agent (such as sodium benzoisothazolinone) is added to the aqueous dispersion.

In the photothermographic of the invention, a development accelerating agent, such as a phosphonic amide phenol compound represented by the formula (A) in JP-A-2000-267222 and JP-A-2000-330234, a hindered phenol compound represented by the formula (II) in JP-A-2001-92075, a hydrazine compound represented by the formula (1) in JP-A-10-62895 and JP-A-11-15116, and a phenol or naphthol compound represented by the formula (2) in Japanese Patent Application No. 2000-76240, is preferably used.

The development accelerating agent is generally used in an amount in a range of from 0.1 to 20% by mole, preferably in a range of from 0.5 to 10% by mole, and more preferably in a range of from 1 to 5% by mole, based on the reducing agent. The introduction method therefor may be the similar method as used for the reducing agent, and it is particularly preferably added in the form of a solid dispersion or an emulsion dispersion.

In the case where it is added in the form of an emulsion dispersion, it is preferably added as an emulsion dispersion formed by dispersing by using a high boiling point solvent, which is in a solid state at ordinary temperature, and an auxiliary solvent having a low boiling point, or as a so-called oilless emulsion dispersion using no high boiling point solvent.

A hydrogen bonding compound used in the invention will be described.

In the case where the reducing agent contains an aromatic hydroxyl group (—OH), particularly in the case of the bisphenol compound, it is preferred that a non-reducing compound having a group capable of forming a hydrogen bond with that group is used in combination.

Examples of the group forming a hydrogen bond with a hydroxyl group or an amino group include a phosphoryl group, a sulfoxide group, a sulfonyl group, a carbonyl group, an amide group, an ester group, a urethane group, a ureido group, a tertiary amino group and a nitrogen-containing aromatic group.

Among these, compounds having a phosphoryl group, a sulfoxide group, an amide group (provided that it has no>N—H group but is blocked as >N—Ra (wherein Ra represents a substituent other than H)), a urethane group (provided that it has no >N—H group but is blocked as >N—Ra (wherein Ra represents a substituent other than H)) or a ureido group (provided that it has no >N—H group but is blocked as >N—Ra (wherein Ra represents a substituent other than H)) are preferred.

The hydrogen bonding compound in the invention is particularly preferably a compound represented by the following formula (D):

(D)

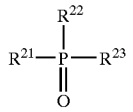

wherein $R^{21}$ to $R^{23}$ each independently represents an alkyl group, an aryl group, an alkoxy group, an aryloxy group, an amino group or a heterocyclic group, which may be unsubstituted or substituted.

Examples of the substituent in the case where the groups represented by $R^{21}$ to $R^{23}$ are substituted include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group. Preferred examples of the substituent include an alkyl group and an aryl group, and examples thereof include a methyl group, an ethyl group, an isopropyl group, a t-butyl group, a t-octyl group, a phenyl group, a 4-alkoxyphenyl group and a 4-acyloxyphenyl group.

Specific examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group and a 2-phenoxypropyl group.

Examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Examples of the aryloxy group include a phenoxy group, a cresyloxy group, an isopropylphenoxy group, a 4-t-butylphenoxy group, a naphthoxy group and a biphenyloxy group.

Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

$R^{21}$ to $R^{23}$ each preferably represents an alkyl group, an aryl group, an alkoxy group or an aryloxy group. It is preferred from the standpoint of the effect of the invention that at least one of $R^{21}$ to $R^{23}$ represents an alkyl group or an aryl group, and it is more preferred that two or more of them each represents an alkyl group or an aryl group. A compound having the same groups for $R^{21}$ to $R^{23}$ is preferred since the compound can be inexpensively available.

Specific examples of the hydrogen bonding agent of the invention including the compounds represented by the formula (D) will be described below, but the invention is not construed as being limited thereto.

(II-1)

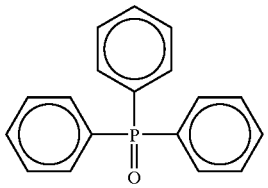

(II-2)

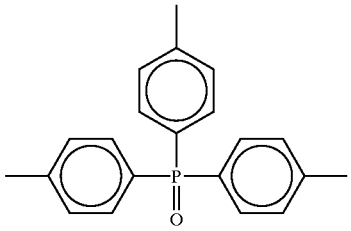

(II-3)

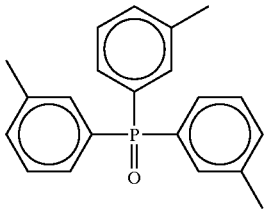

(II-4)

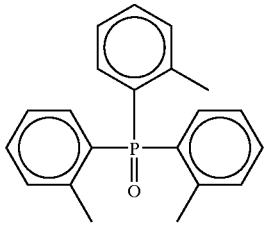

(II-5)

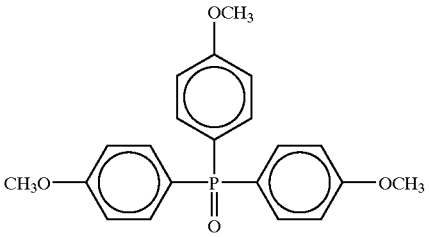

(II-6)

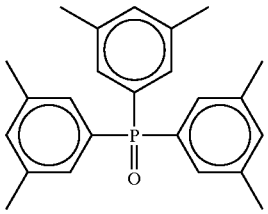

(II-7)

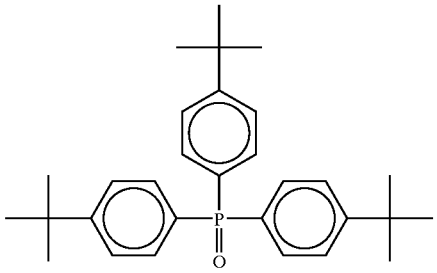

-continued (II-8)

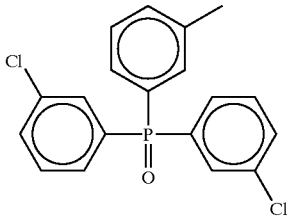

(II-9)

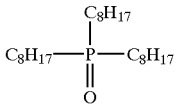

(II-10)

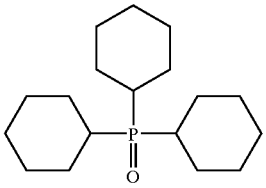

(II-11)

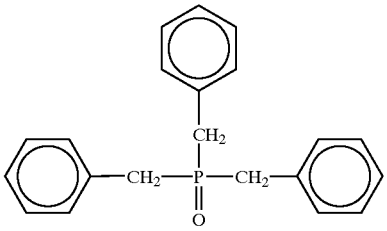

(II-12)

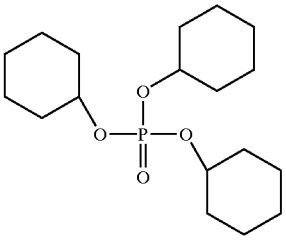

(II-13)

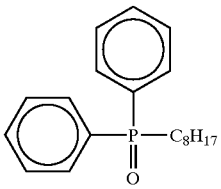

(II-14)

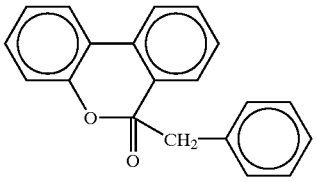

(II-15)

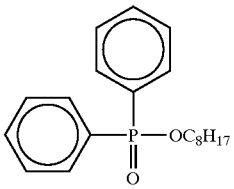

-continued (II-16)

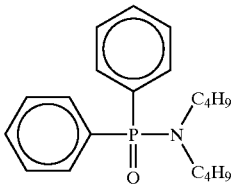

(II-17)

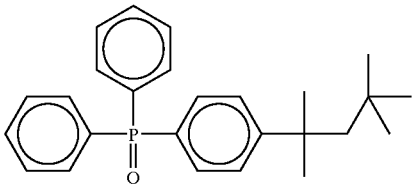

(II-18)

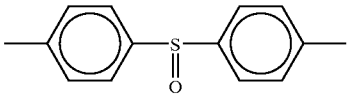

(II-19)

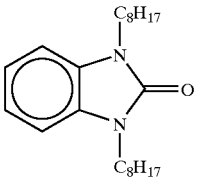

(II-20)

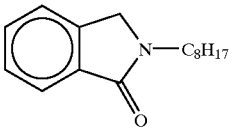

(II-21)

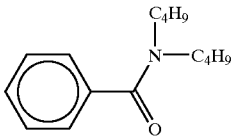

Specific examples of the hydrogen bonding compound include those disclosed in European Patent No. 1,096,310 and Japanese Patent Application Nos. 2000-270498 and 2001-124796, in addition to the foregoing compounds.

The compound represented by the formula (D) of the invention can be contained in a coating composition, as similar to the reducing agent, in the form of a solution, an emulsion dispersion or a solid dispersed fine particle dispersion to be used in the photosensitive material. The compound of the invention forms a hydrogen bonding complex with a compound having a phenolic hydroxyl group or an amino group in the form of a solution, and can be isolated in as a complex in the form of crystals depending on the combination of the reducing agent and the compound represented by the formula (D) of the invention. The use of the thus isolated crystalline powder as a solid dispersed fine particle dispersion is preferred for obtaining stable performance. Such a method is also preferably employed in that the reducing agent and the compound represented by the formula (D) of the invention are mixed in the form of powder and then subjected to complex formation upon dispersing by using a suitable dispersing agent with, for example, a sand grinder mill (SGM).

The compound represented by the formula (D) is preferably used in an amount of from 1 to 200% by mole, more preferably from 10 to 150% by mole, and further preferably from 20 to 100% by mole, based on the reducing agent.

A binder used in the invention will be described.

The binder of the layer containing the organic silver salt of the invention may be any polymer, and suitable examples of the polymer include those that are transparent or translucent and are generally colorless. Examples thereof include a natural resin, a synthetic resin, polymer or copolymer, and other media that form a film, such as a gelatin compound, a rubber compound, a poly (vinyl alcohol) compound, a hydroxyethylcellulose compound, a cellulose acetate compound, a cellulose acetate butyrate compound, a poly (vinylpyrrolidone) compound, casein, starch, a poly(acrylic acid) compound, a poly(methyl methacrylate) compound, a poly (vinyl chloride) compound, a poly(methacrylic acid) compound, a styrene-maleic anhydride copolymer, a styrene-acrylonitrile copolymer, a styrene-butadiene copolymer, a poly(vinyl acetal) compound (for example, poly(vinyl formal) and poly(vinyl, butyral)), a poly(ester) compound, a poly(urethane) compound, a phenoxy resin, a poly(vinylidene chloride) compound, a poly(epoxide) compound, a poly(carbonate) compound, a poly(vinyl acetate) compound, a poly(olefin) compound, a cellulose ester compound and a poly(amide) compound.

The binder may be formed into a coated layer from a solution of water or an organic solvent or from an emulsion.

The binder that can be used in combination in the layer containing the organic silver salt in the invention preferably has a glass transition temperature Tg of from 0 to 80° C., more preferably from 10 to 70° C., and further preferably from 15 to 65° C. (hereinafter sometimes referred to as a high Tg binder).

Tg in the invention is calculated according to the following equation.

$$1/Tg=\Sigma(Xi/Tgi)$$

Herein, it is assumed that the polymer is formed by copolymerizing n monomers, i.e., i=1 to n. Xi means the weight fraction of the i-th monomer ($\Sigma Xi=1$), and Tgi means the glass transition temperature (in terms of absolute temperature) of a homopolymer of the i-th monomer. $\Sigma$ means the sum of from i=1 to n.

For the values of the glass transition temperatures of the homopolymers of the respective monomers (Tgi), the values disclosed in J. Brandrup and E. H. Immergut, Polymer Handbook 3rd Edition, published by Wiley-Interscience (1989).

Two or more kinds of binders may be used in combination depending on necessity. A binder having a glass transition temperature of 20° C. or more and that having a glass transition temperature of less than 20° C. may be used in combination. In the case where two or more kinds of polymers having different Tg values are used in combination, it is preferred that the weight average Tg falls within the foregoing range.

In the invention, a coated film of the layer containing the organic silver salt is preferably formed by coating and drying a coating composition containing water in an amount of 30% by weight or more based on the total amount of the solvent contained.

In the case where the layer containing the organic silver salt is formed by coating and drying a coating composition containing water in an amount of 30% by weight or more based on the total amount of the solvent contained, and in the case where the binder of the layer containing the organic silver salt can be dissolved or dispersed in an aqueous solvent (water solvent), the performance is improved when the binder is formed with polymer latex having an equilibrium water content at 25° C. and 60% RH of 2% by weight or less. The most preferred embodiment is that having been prepared to have an ionic electroconductivity of 2.5 mS/cm or less, and examples of the preparation method therefor include a method of purifying the polymer after synthesis by using a separation functional membrane.

The aqueous solvent herein, in which the polymer can be dissolved or dispersed, means water or a mixture of water and 70% by weight or less of a water miscible organic solvent.

Examples of the water miscible organic solvent include an alcohol solvent, such as methyl alcohol, ethyl alcohol and propyl alcohol, a cellosolve solvent, such as methylcellosolve, ethylcellosolve and butylcellosolve, ethyl acetate, and dimethylformamide.

In the case where the polymer is not thermodynamically dissolved in a system but is present in a dispersed state, the system is referred by the term aqueous solvent herein.

The term "equilibrium water content at 25° C. and 60% RH (% by weight)" herein can be expressed by using the weight W1 of the polymer that is in a humidity equilibrium under an atmosphere at 25° C. and 60% RH and the weight W0 of the polymer that is in an absolute dry state according to the following equation.

$$\text{Equilibrium water content at 25° C. and 60\% RH}=((W1-W0)/W0)\times 100$$

With respect to the definition of the water content and the measurement method therefor, for example, *Kobunshi Jikken Koza* 14 (Polymer Experimental Course 14), Kobunshi Zairyo Shiken-ho (Test Methods of Polymer Materials), edited by Polymer Society of Japan, published by Chijin Shokan Co., Ltd. can be referred.

The equilibrium water content at 25° C. and 60% RH of the polymer of the binder of the invention is preferably 2% by weight or less, more preferably from 0.01 to 1.5% by weight, and further preferably from 0.02 to 1% by weight.

In the invention, a polymer that can be dispersed in an aqueous solvent is particularly preferred. Examples of the dispersed state include latex having fine particles of a water insoluble hydrophobic polymer dispersed therein and a dispersed state having a polymer dispersed therein by forming a molecular state or a micellar state, and the particles dispersed in a latex state are more preferred.

The dispersed particles generally have an average particle diameter of from 1 to 50,000 nm, preferably from 5 to 1,000 nm, more preferably from 10 to 500 nm, and further preferably from 50 to 200 nm. The particle size distribution of the dispersed particles is not particularly limited, and those having a broad particle size distribution and those having a mono disperse particle size distribution may be used. Such a method is preferred for controlling the property of the coating composition that two or more kinds of dispersed particles having monodisperse particle size distributions.

Preferred examples of the polymer that can be dispersed in an aqueous solvent in the invention include a hydrophobic polymer, such as an acrylic polymer, a poly(ester) compound, a rubber compound (such as an SBR resin), a poly (urethane) compound, a poly (vinyl chloride) compound, a poly(vinyl acetate) compound, a poly (vinylidene chloride) compound and a poly(olefin) compound. The polymer may be either a linear polymer, a branched polymer or a crosslinked polymer, and may be either a so-called homopolymer formed by polymerizing a single monomer or a copolymer formed by polymerizing two or more kinds of monomers. The copolymer may be either a random copolymer or a block copolymer.

The molecular weight of the polymer is generally, in terms of number average molecular weight, from 5,000 to 1,000,000, and preferably from 10,000 to 200,000. A polymer having a too small molecular weight is insufficient in mechanical strength of the emulsion layer, and that having a too large molecular weight is not preferred due to deteriorated film forming property. Crosslinkable polymer latex is particularly preferably used.

Preferred examples of the polymer latex will be described below, but the invention is not construed as being limited thereto.

In the following description, expression is made by using the names of raw material monomers with the numbers within parentheses for percent by weight, and the molecular weight is a number average molecular weight Mn. In the case where a crosslinked structure is formed owing to the use of a polyfunctional monomer, the indication of molecular weight is omitted but is indicated as "crosslinked" because the concept of molecular weight cannot be applied to the crosslinked structure. Tg means a glass transition temperature.

P-1: Latex of MMA(70)-EA(27)-MAA(3) (Mn: 37,000, Tg: 61° C.)

P-2: Latex of MMA(70)-2EHA(20)-St(5)-AA(5) (Mn: 40,000, Tg: 59° C.)

P-3: Latex of St(50)-Bu(47)-MAA(3) (crosslinked, Tg: −17° C.)

P-4: Latex of St(68)-Bu(29)-AA(3) (crosslinked, Tg: 17° C.)

P-5: Latex of St(71)-Bu(26)-AA(3) (crosslinked, Tg: 24° C.)

P-6: Latex of St(70)-Bu(27)-IA(3) (crosslinked)

P-7: Latex of St(75)-Bu(24)-AA(1) (crosslinked, Tg: 29° C.)

P-8: Latex of St(60)-Bu(35)-DVB(3)-MAA(2) (crosslinked)

P-9: Latex of St(70)-Bu(25)-DVB(2)-AA(3) (crosslinked)

P-10: Latex of VC(50)-MAA(20)-EA(20)-AN(5)-AA(5) (Mn: 80,000)

P-11: Latex of VDC(85)-MMA(5)-EA(5)-MAA(5) (Mn: 67,000)

P-12: Latex of Et(90)-MAA(10) (Mn: 12,000)

P-13: Latex of St(70)-2EHA(27)-AA(3) (Mn: 130,000, Tg: 43° C.)

P-14: Latex of MMA(63)-EA(35)-AA(2) (Mn: 33,000, Tg: 47° C.)

P-15: Latex of St(70.5)-Bu(26.5)-AA(3) (crosslinked, Tg: 23° C.)

P-16: Latex of St(69.5)-Bu(27.5)-AA(3) (crosslinked, Tg: 20.5° C.)

In the foregoing structures, the abbreviations of monomers have the following meanings. MMA represents methyl methacrylate, EA represents ethyl acrylate, MAA represents methacrylic acid, 2EHA represents 2-ethylhexyl acrylate, St represents styrene, Bu represents butadiene, AA represents acrylic acid, DVB represents divinylbenzene, VC represents vinyl chloride, AN represents acrylonitrile, VDC represents vinylidene chloride, Et represents ethylene, and IA represents itaconic acid.

The foregoing polymer lattices are commercially available, and the following polymers can be used. Examples of an acrylic polymer include Cevian A-4635, 4718 and 4601 (produced by Daicel Chemical Industries, Ltd.) and Nipol Lx 811, 814, 821, 820 and 857 (produced by Nippon Zeon Corp.), examples of a poly(ester) compound include FINETEX ES 650, 611, 675 and 850 (produced by Dainippon Ink And Chemicals, Inc.) and WD-size and WMS (produced by Eastman Chemicals, Inc.), examples of a poly (urethane) compound include HYDRAN AP 10, 20, 30 and 40 (produced by Dainippon Ink And Chemicals, Inc.), examples of a rubber compound include LACSTAR 7310K, 3307B, 4700H and 7132C (produced by Dainippon Ink And Chemicals, Inc.) and Nipol Lx 416, 410, 438C and 2507 (produced by Nippon Zeon Corp.), examples of a poly (vinyl chloride) compound include G351 and G576 (produced by Nippon Zeon Corp.), examples of a poly(vinylidene chloride) compound include L502 and L513 (produced by Asahi Kasei Corp.), and examples of a poly (olefin) compound include Chemipearl S120 and SA100 (produced by Mitsui Chemicals, Inc.).

These polymer lattices may be used solely or as a mixture of two or more of them depending on necessity.

The polymer latex used in the invention is particularly preferably latex of a styrene-butadiene copolymer. The weight ratio of the styrene monomer unit and the butadiene monomer unit in the styrene-butadiene copolymer is preferably from 40/60 to 95/5. The proportion of the styrene monomer unit and the butadiene monomer unit in the copolymer is preferably from 60 to 90% by weight. The polymer latex of the invention preferably contains acrylic acid or methacrylic acid in an amount of from 1 to 6% by weight, more preferably from 2 to 5% by weight, based on the total amount of styrene and butadiene. The polymer latex of the invention preferably contains acrylic acid.

Preferred examples of the latex of a styrene-butadiene copolymer used in the invention include P-3 to P-8 and P-15 described in the foregoing and LACSTAR 3307B and 7132C and Nipol Lx 416, which are commercially available.

The latex of a styrene-butadiene copolymer preferably has a glass transition temperature Tg of from 10 to 30° C., and more preferably from 17 to 25° C.

In the layer containing the organic silver salt in the photosensitive material of the invention, a hydrophilic polymer, such as gelatin, polyvinyl alcohol, methyl cellulose, hydroxypropyl cellulose and carboxymethyl cellulose, may be added depending on necessity. The addition amount of the hydrophilic polymer is preferably 30% by weight or less, and more preferably 20% by weight or less, based on the total binder in the layer containing the organic silver salt.

The layer containing the organic silver salt (i.e., the image forming layer) of the invention is preferably produced by using polymer latex. The amount of the binder in the layer containing the organic silver salt is preferably, in terms of a weight ratio of total binder/organic silver salt, from 1/10 to 10/1, more preferably from 1/3 to 5/1, and further preferably from 1/1 to 3/1.

The layer containing the organic silver salt is generally a photosensitive layer (emulsion layer) containing a photosensitive silver halide, which is a photosensitive silver salt, and the weight ratio of total binder/silver halide in this case is preferably 400/1 to 5/1, and more preferably from 200/1 to 10/1.

The amount of the total binder in the image forming layer of the invention is preferably from 0.2 to 30 g/m$^2$, more preferably from 1 to 15 g/m$^2$, and further preferably from 2 to 10 g/m$^2$. In the image forming layer of the invention, a crosslinking agent for crosslinking, a surface active agent for improving coating property, and the like may be added.

(Preferred Solvent for Coating Composition)

A solvent for a coating composition for forming the layer containing the organic silver salt of the photosensitive material in the invention (a solvent and a dispersion medium are totally referred to as a solvent herein for simplicity) is preferably an aqueous solvent containing 30% by weight or more water.

As a component other than water, an arbitrary water miscible solvent, such as methyl alcohol, ethyl alcohol, isopropyl alcohol, methylcellosolve, ethylcellosolve, dimethylformamide and ethyl acetate, may be used. The water content of the solvent is preferably 50% by weight of more, and more preferably 70% by weight or more.

Preferred examples of the solvent composition include water, water/methyl alcohol=90/10, water/methyl alcohol=70/30, water/methyl alcohol/dimethyformamide=80/15/5, water/methyl alcohol/ethylcellosolve=85/10/5 and water/methyl alcohol/isopropyl alcohol=85/10/5 (the numerals are in terms percent by weight).

An antifoggant used in the invention will be described.

Examples of an antifoggant, a stabilizer and a stabilizer precursor that can be used in the invention include those disclosed in paragraph 0070 of JP-A-10-62899 and page 20, line 57 to page 21, line 7 of EP 0,803,764A1, compounds disclosed in JP-A-9-281637 and JP-A-9-329864, and compounds disclosed in U.S. Pat. No. 6,083,681 and European Patent No. 1,048,975.

An antifoggant that can be preferably used in the invention is an organic halogenide, and examples thereof include those disclosed in paragraphs 0111 to 0112 of JP-A-11-65012. Particularly preferred examples thereof include an organic halogenide represented by the formula (P) in JP-A-2000-284399, an organic polyhalogen compound represented by the formula (II) in JP-A-10-339934 and an organic polyhalogen compound disclosed in JP-A-2001-31644 and JP-A-2001-33911.

The organic polyhalogen compound that is preferred in the invention will be specifically described below.

The preferred polyhalogen compound in the invention includes a compound represented by the following formula (H):

$$Q\text{-}(Y)_N\text{—}C(Z_1)(Z_2)X \qquad (H)$$

wherein Q represents an alkyl group, an aryl group or a heterocyclic group, Y represents a divalent linking group, N represents 0 or 1, $Z_1$ and $Z_2$ each represents a halogen atom, and X represents a hydrogen atom or an electron attracting group.

In the formula (H), Q preferably represents a phenyl group substituted with an electron attracting group having a positive Hammett's substituent constant σp. With respect to the Hammett's substituent constant, *Journal of Medicinal Chemistry*, vol. 16, No. 11, p. 1207 to 1216 (1973) may be referred.

Examples of the electron attracting group include a halogen atom (such as a fluorine atom (σp value: 0.06), a chlorine atom (σp value: 0.23), a bromine atom (σp value: 0.23 and an iodine atom (σp value: 0.18)), a trihalomethyl group (such as a trobromomethyl group (σp value: 0.29), a trichloromethyl group (σp value: 0.33) and a trifluoromethyl group (σp value: 0.54)), a cyano group (σp value: 0.66), a nitro group (σp value: 0.78), an aliphatic sulfonyl group (such as a methanesulfonyl group (σp value: 0.72)), an arylsulfonyl group, a heterocyclic sulfonyl group, an aliphatic acyl group (such as an acetyl group (σp value: 0.50)), an arylacyl group (such as a benzoyl group (σp value: 0.43)), a heterocyclic acyl group, an alkynyl group (such as a C≡CH group (σp value: 0.23)), an aliphatic oxycarbonyl group (such as a methoxycarbonyl group (σp value: 0.45)), an aryloxycarbonyl group (such as a phenoxycarbonyl group (σp value: 0.44)), a heterocyclic oxycarbonyl group, a carbamoyl group (σp value: 0.36), a sulfamoyl group (σp value: 0.57), a sulfoxide group, a heterocyclic group and a phosphoryl group. The σp value is preferably in a range of from 0.2 to 2.0, and more preferably in a range of from 0.4 to 1.0.

Particularly preferred examples of the electron attracting group include a carbamoyl group, an alkoxycarbonyl group, an alkylsulfonyl group and an alkylphosphoryl group, and among these, a carbamoyl group is most preferred.

X preferably represents an electron attracting group, and more preferably represents a halogen atom, an aliphatic sulfonyl group, an arylsulfonyl group, a heterocyclic sulfonyl group, an aliphatic acyl group, an arylacyl group, a heterocyclic acyl group, an aliphatic oxycarbonyl group, an aryloxycarbonyl group, a heterocyclic oxycarbonyl group, a carbamoyl group or a sulfamoyl group, with a halogen atom being most preferred. The halogen atom is preferably a chlorine atom, a bromine atom or an iodine atom, and more preferably a chlorine atom or a bromine atom, with a bromine atom being particularly preferred.

Y preferably represents —C(=O)—, —SO— or —$SO_2$—, more preferably represents —C(=O)— or —$SO_2$—, and particularly preferably represents —$SO_2$—. N represents 0 or 1, and preferably represents 1.

Specific examples of the compound represented by the formula (H) in the invention will be described below.

(III-1)

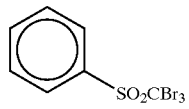

(III-2)

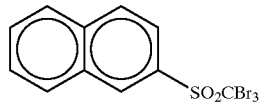

(III-3)

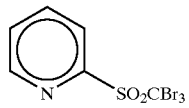

(III-4)

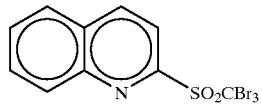

(III-5)

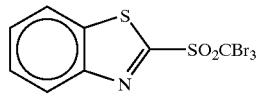

(III-6)

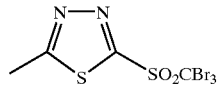

(III-7)

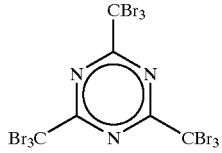

(III-8)

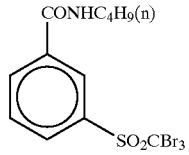

-continued (III-9)

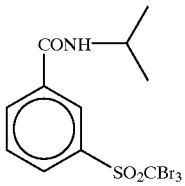

(III-10)

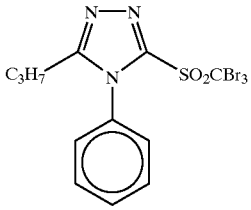

(III-11)

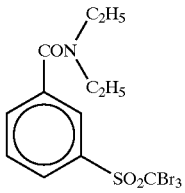

(III-12)

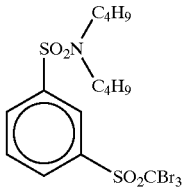

(III-13)

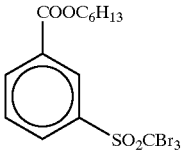

(III-14)

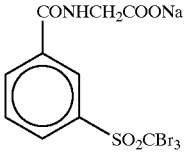

(III-15)

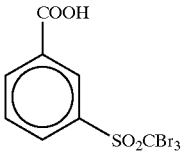

(III-16)

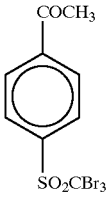

-continued (III-17)

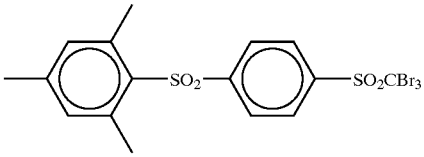

(III-18)

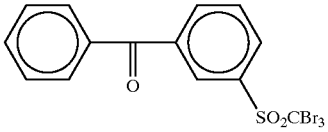

(III-19)

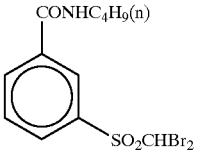

(III-20)

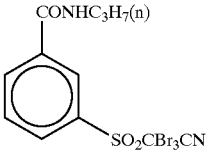

(III-21)

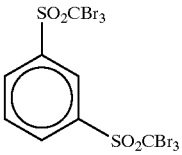

(III-22)

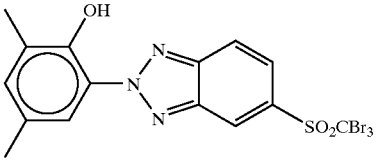

(III-23)

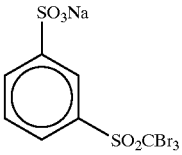

(III-24)

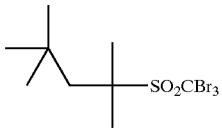

The compound represented by the formula (H) in the invention is preferably used in an amount of from $1\times10^{-4}$ to 0.5 mole, more preferably from $1\times10^{-3}$ to 0.1 mole, and further preferably from $5\times10^{-3}$ to 0.05 mole, per 1 mole of the nonphotosensitive silver salt in the image forming layer.

Examples of the method for adding the antifoggant into the photosensitive material include those method described for adding the reducing agent, and the organic polyhalogen compound is also preferably added in the form of a solid fine particle dispersion.

Other examples of the antifoggant include a mercury(II) salt disclosed in paragraph 0113 of JP-A-11-65021, a benzoic acid compound disclosed in paragraph 0114 of the same publication, a formalin scavenger compound represented by the formula (S) disclosed in JP-A-2000-221634, a triazine compound disclosed in the claim 9 of JP-A-11-352624, a compound represented by the formula (III) disclosed in JP-A-6-11791, and 4-hydroxy-6-methyl-1,3,3a,7-tetrazaindene.

The photothermographic material of the invention may contain an azolium salt for preventing fogging. Examples of the azolium salt include a compound represented by the formula (XI) disclosed in JP-A-59-193447, a compound disclosed in JP-B-55-12581, and a compound represented by the formula (II) disclosed in JP-A-60-153039. The azolium salt may be any position of the photosensitive material, and it is preferably added to a layer on the surface, on which the photosensitive layer is present, and more preferably added to the layer containing the organic silver salt.

The addition of the azolium salt may be carried out in any step for preparing the coating composition, and in the case where it is added to the layer containing the organic silver salt, it may be added in any step of from preparation of the organic silver salt to preparation of the coating composition, and is preferably added in a step after preparation of the organic silver salt to a step immediately before coating. The azolium salt may be added in any method including powder, a solution or a fine particle dispersion. It may also be added in the form of a solution mixed with other additives, such as a sensitizing dye, a reducing agent and a toning agent.

The addition amount of the azolium salt in the invention maybe arbitrarily determined and is preferably from $1\times10^{-6}$ to 2 mole, and more preferably from $1\times10^{-3}$ to 0.5 mole, per 1 mole of silver.

In the invention, a mercapto compound, a disulfide compound and a thione compound may be added to suppress or accelerate development, to control development, to improve spectral sensitizing efficiency, and to improve storage stability before and after development. Examples thereof include compounds disclosed in paragraphs 0067 to 0069 of JP-A-10-62899, a compound represented by the formula (I) disclosed in JP-A-10-186572, specific example of which include those disclosed in paragraphs 0033 to 0052 of the same publication, and compounds disclosed in page 20, lines 36 to 56 of EP 0,803,764A1. Among these, mercapto-substituted heterocyclic aromatic compounds disclosed in JP-A-9-297367, JP-A-9-304875 and JP-A-2001-100358 are preferred.

A plasticizer and a lubricating agent that can be used in the photosensitive layer of the invention are disclosed in paragraph 0117 of JP-A-11-65021, a super high contrast agent for forming a super high contrast image and a addition method therefor that can be used therein are disclosed in paragraph 0118 of the same publication, paragraphs 0136 to 0193 of JP-A-11-223898, compounds represented by the formula (H), the formulae (1) to (3) and the formulae (A) and (B) disclosed in JP-A-2000-284399, and compounds represented by the formulae (III) to (V) disclosed in Japanese Patent Application No. 11-91652 (specific examples of which include compounds 21 to 24), and a contrast increasing accelerator that can be used therein is disclosed in paragraph 0102 of JP-A-11-65021 and paragraphs 0194 to 0195 of JP-A-11-223898.

In order to use formic acid or a formate as a forced fogging agent, it is preferably contained on the side where the image forming layer containing the photosensitive silver halide is present in an amount of 5 mmole or less, and more preferably 1 mmole or less, per 1 mole of silver.

In the case where a super high contrast agent in the photothermographic material of the invention, it is preferred that an acid formed by hydrating diphosphorous pentaoxide or a salt thereof is used in combination.

Examples of the acid formed by hydrating diphosphorous pentaoxide or a salt thereof include metaphosphoric acid (or a salt thereof), pyrophosphoric acid (or a salt thereof), orthophosphoric acid (or a salt thereof), triphosphoric acid (or a salt thereof), tetraphosphoric acid (or a salt thereof) and a hexametaphosphoric acid (or a salt thereof).

Preferred examples of the acid formed by hydrating diphosphorous pentaoxide or a salt thereof include orthophosphoric acid (or a salt thereof) and a hexametaphosphoric acid (or a salt thereof).

Specific examples of the salt include sodium orthophosphate, sodium dihydrogen orthophosphate, sodium hexametaphosphate and ammonium hexametaphosphate.

The using amount of the acid formed by hydrating diphosphorous pentaoxide or a salt thereof may be arbitrarily determined according to the performance including sensitivity and fogging, and is preferably from 0.1 to 500 mg/m$^2$, and more preferably from 0.5 to 100 g/m$^2$, in terms of a coating amount per 1 m$^2$ of the photosensitive material.

The photothermographic material of the invention may have a surface protective layer for such a purpose as prevention of adhesion of the image forming layer. The surface protective layer may be a single layer or may have a multilayer structure. The surface protective layer is disclosed in paragraphs 0119 to 0120 of JP-A-11-65021 and Japanese Patent Application No. 2000-171936.

As a binder for the surface protective layer, gelatin can be preferably used, and it is also preferred that polyvinyl alcohol (PVA) is used or used in combination. Examples of gelatin include inert gelatin (such as Nitta Gelatin 750) and phthalated gelatin (such as Nitta Gelatin 801).

Examples of PVA include those disclosed in paragraphs 0009 to 0020of JP-A-2000-171936, and preferred examples thereof include PVA-105, which is a completely saponified product, PVA-205 and PVA-335, which are partially saponified products, and MP-203, which is a modified polyvinyl alcohol, all of which are trade name of commercial products produced by Kuraray Co., Ltd.

The coating amount of polyvinyl alcohol in the protective layer (per one layer) in terms of an amount per 1 m$^2$ of the support is preferably from 0.3 to 4.0 g/m$^2$, and more preferably from 0.3 to 2.0 g/m$^2$.

In the case where the photothermographic material of the invention is used for printing purpose, in which dimensional change causes problems, polymer latex is preferably used in the surface protective layer and a backing layer.

The polymer latex is disclosed in Goseijusi Emulsion (Synthetic Resin Emulsion), edited by T. Okuda and H. Inagaki, published by Kobunshi Kankokai Co., Ltd. (1978), Gosei Latex no Oyo (Applications of Synthetic Latex), edited by T. Sugimura, Y. Kataoka, S. Suzuki and K. Ogasawara, published by Kobunshi Kankokai Co., Ltd. (1993), and Gosei Latex no Kagaku (Chemistry of Synthetic Latex), by S. Muroi, published by Kobunshi Kankokai Co., Ltd. (1970), and specific examples thereof include latex of a copolymer of methyl methacrylate (33.5% by weight)/ethyl acrylate (50% by weight)/methacrylic acid (16.5% by weight), latex of a copolymer of methyl methacrylate (47.5% by weight)/butadiene (47.5% by weight)/itaconic acid (5% by weight), latex of a copolymer of ethyl acrylate (50% by weight)/methacrylic acid (50% by weight), latex of a copolymer of methyl methacrylate (58.9% by weight)/2-ethylhexyl acrylate (25.4% by weight)/styrene (8.6% by weight)/2-hydroxyethyl methacrylate (5.1% by weight)/ acrylic acid (2.0% by weight) and latex of a copolymer of methyl methacrylate (64.0% by weight)/styrene (9.0% by weight)/butyl acrylate (20.0% by weight)/2-hydroxyethyl methacrylate (5.0% by weight)/acrylic acid (2.0% by weight).

Furthermore, as a binder for the surface protective layer, a combination of polymer latex disclosed in Japanese Patent Application No. Hei 11-6872, techniques disclosed in paragraphs 0021 to 0025 of Japanese Patent Application No. Hei 11-143058, techniques disclosed in paragraphs 0027 to 0028 of Japanese Patent Application No. Hei 11-6872 and techniques disclosed in paragraphs 0023 to 0041 of Japanese Patent Application No. Hei 10-199626 may be applied.

The proportion of the polymer latex in the surface protective layer is preferably from 10 to 90% by weight, and particularly preferably from 20 to 80% by weight, based on the total amount of the binder.

The coating amount per 1 $m^2$ of the support of the total binder (including water soluble polymers and latex polymers) in the surface protective layer (per one layer) is preferably from 0.3 to 5.0 $m/m^2$, and more preferably from 0.3 to 2.0 $g/m^2$.

The preparation temperature of the coating composition for forming the image forming layer of the invention is preferably from 30 to 65° C., more preferably 35° C. or more and less than 60° C., and further preferably from 35 to 55° C. It is also preferred that the temperature of the coating composition for forming the image forming layer immediately after the addition of the polymer latex is maintained at a temperature of from 30 to 65° C.

The image forming layer of the invention is constituted with a single layer or two or more layers on the support. In the case where it is constituted with a single layer, it contains the organic silver salt, the photosensitive silver halide, the reducing agent and the binder, and further contains, depending on necessity, auxiliary materials, such as the toning agent, a coating assistant and other assistants. In the case where it is constituted with two or more layers, a first image forming layer (which is generally a layer adjacent to the support) contains the organic silver salt and the photosensitive silver halide, and a second image forming layer or both layers contain some other components.

In the constitution of a multi-color photothermographic photographic material, the combination of the two layers may be contained for the respective colors, and also all the components may be contained in the single layer as described in U.S. Pat. No. 4,708,928. In the case of a multi-dye multi-color photothermographic photographic material, in general, the respective emulsion layers are separately retained by using a functional or non-functional barrier layer among the respective photosensitive layers as described in U.S. Pat. No. 4,460,681.

In the photosensitive layer of the invention, various kinds of dyes and pigments (such as C.I. Pigment Blue 60, C.I. Pigment Blue 64 and C.I. Pigment Blue 15:6) may be used for improving the tone, preventing occurrence of interference fringes upon exposure with laser, and preventing irradiation. These are described in detail in WO98/36322, JP-A-10-268465 and JP-A-11-338098.

In the photothermographic material of the invention, it is preferred that an antihalation layer is provided on a side far from a light source with respect to the photosensitive layer.

The photothermographic material generally has a nonphotosensitive layer in addition to the photosensitive layer. The nonphotosensitive layer can be classified into (1) a protective layer provided on the photosensitive layer (on a side far from the support), (2) an intermediate layer provided between the plural photosensitive layer or between the photosensitive layer and the protective layer, (3) an undercoating layer provided between the photosensitive layer and the support, and (4) a backing layer provided on an opposite side to the photosensitive layer. A filter layer is provided in the photosensitive material as the layer (1) or (2). The antihalation layer is provided in the photosensitive layer as the layer (3) or (4).

The antihalation layer is described in paragraphs 0123 to 0124 of JP-A-11-65021, JP-A-11-223898, JP-A-9-230531, JP-A-10-36695, JP-A-10-104779, JP-A-11-231457, JP-A-11-352625 and JP-A-11-352626.

The antihalation layer contains an antihalation dye having absorption at the exposure wavelength. The wavelength of the exposure laser in the invention has a peak wavelength in a range of from 350 to 450 nm, and therefore, such a dye is preferably used for antihalation that absorbs light in that wavelength range.

In the case where a dye having absorption in the visible region is used for preventing halation, it is preferred that the color of the dye does substantially not remain after the image formation. It is preferred to use a means for decoloring with heat upon thermal development, and particularly it is preferred that a thermal decoloring dye and a base precursor are added to a nonphotosensitive layer to function as an antihalation layer. These techniques are described in JP-A-11-231457.

The addition amount of the decoloring dye is determined by the purpose of the dye. In general, it is preferably used in such an amount that provides an optical density (absorbance) exceeding 0.1 upon measuring at the objective wavelength. The optical density is preferably form 0.15 to 2, and more preferably from 0.2 to 1. The using amount of the dye for providing the optical density range is generally about from 0.001 to 1 $g/m^2$.

Upon decoloring the dye, the optical density after the thermal development can be decreased to 0.1 or less. Two or more kinds of decoloring dyes may be used in combination in a thermal decoloring recording material or the photothermographic material. Similarly, two or more kinds of the base precursors may be used in combination.

In the thermal decoloration system using the decoloring dye and the base precursor, it is preferred from the standpoint of thermal decoloration to use a substance that lowers the melting point by 3° C. or more upon mixing with the base precursor described in JP-A-11-352626 (such as diphenylsulfone, 4-chlorophenyl (phenyl) sulfone) and2-naphtyl benzoate).

In the invention, a coloring agent having an absorption maximum at from 300 to 450 nm may be added for improving silver color tone and the time-lapse change of the image. The coloring agent is described in JP-A-62-210458, JP-A-63-104046, JP-A-63-103235, JP-A-63-208846, JP-A-63-306436, JP-A-63-314535, JP-A-1-61745 and JP-A-2001-100363.

The coloring agent is generally added in an amount of from 0.1 $mg/m^2$ to 1 $g/m^2$, and the addition layer is preferably a backing layer provided on the opposite side to the photosensitive layer.

The photothermographic material of the invention is preferably a so-called single sided photosensitive material having at least a photosensitive layer containing a silver halide emulsion on one side of a support, and having a backing layer on the other side thereof.

In the invention, a matting agent is preferably added to improve conveying property, and the matting agent is described in paragraphs 0126 to 0127 of JP-A-11-65021.

The amount of the matting agent in terms of a coating amount per 1 $m^2$ of the photosensitive material is preferably from 1 to 400 $mg/m^2$, and more preferably from 5 to 300 $mg/m^2$.

The shape of the matting agent in the invention may be a regular shape or an irregular shape and is preferably a regular shape with a spherical shape being more preferred. The average particle diameter thereof is preferably from 0.5 to 10 $\mu$m, more preferably from 1.0 to 8.0 $\mu$m, and further preferably from 2.0 to 6.0 $\mu$m. The variation coefficient of the size distribution is preferably 50% or less, more preferably 40% or less, and further preferably 30% or less. The variation coefficient herein is a value expressed by (standard deviation of particle diameter)/(average value of particle diameter)×100. It is preferred to use two kinds of matting agent with small variation coefficients having average particle diameters that are different from each other by a ratio of 3 or more.

The matting degree on the emulsion surface is not limited as far as the so-called stardust phenomenon, in which small white dropouts are formed on the image part to cause leakage of light, is not caused, and it is preferably to provide a Beck's smoothness of from 30 to 2,000 seconds, and particularly preferably from 40 to 1,500 seconds. The Beck's smoothness can be conveniently obtained according to JIS P8119 (Smoothness Test Method by Beck's Testing Machine for Paper and Paperboard) and TAPPI Standard Method T479.

The matting degree of the backing layer in the invention is preferably to provide a Beck's smoothness of from 10 to 1,200 seconds, more preferably from 20 to 800 seconds, and further preferably from 40 to 500 seconds.

In the invention, the matting agent is preferably contained in the outermost layer or a layer functioning as the outermost layer of the photosensitive material or a layer in the vicinity of the outermost layer, and it is also preferably contained in a layer functioning as a so-called protective layer.

The backing layer that can be applied to the invention is described in paragraphs 0128 to 0130 of JP-A-11-65021.

The photothermographic material of the invention has a film surface pH before thermal development of 7.0 or less, and more preferably 6.6 or less. The lower limit thereof is not particularly determined and is about 3. The most preferred pH range is from 4 to 6.2.

The adjustment of the film surface pH is preferably carried out by using an organic acid, such as a phthalic acid derivative, a nonvolatile acid, such as sulfuric acid, or a volatile base, such as ammonia, from the standpoint of lowering of the film surface pH. In particular, ammonia is preferred to attain a low film surface pH since it can be removed before the coating step or the thermal development.

A nonvolatile base, such as sodium hydroxide, potassium hydroxide and lithium hydroxide, is preferably used in combination with ammonia. The method for measuring the film surface pH is described in paragraph 0123 of Japanese Patent Application No. 11-87297.

A film hardener may be used in the layers including the photosensitive layer, the protective layer and the backing layer of the invention. Examples of the film hardener include those disclosed in T. H. James, *The Theory of the Photographic Process, Fourth Edition*, p. 77 to 78, published by Macmillan Publishing Co., Inc. (1977), and preferred examples thereof include chromium alum, 2,4-dichloro-6-hydroxy-s-triazine sodium salt, N,N-ethylene-bis (vinylsulfonacetamide) and N,N-propylene-bis (vinylsulfonacetamide), and also polyvalent metallic ions disclosed on page 78 of the same literature, polyisocyanate compounds disclosed in U.S. Pat. No. 4,281,060 and JP-A-6-208193, an epoxy compound disclosed in U.S. Pat. No. 4,791,042, and a vinylsulfone compound disclosed in JP-A-62-89048.

The film hardener is added in the form of a solution. The addition timing of the solution to the coating composition for forming the protective layer is generally from 180 minutes before coating to immediately before coating, and preferably 60 minutes before to 10 seconds before coating, and the mixing method and the mixing conditions are not particularly limited as far as the effect of the invention is sufficiently exerted.

Specific examples of the mixing method include a method using a tank that designates a desired mean residence time calculated from the addition flow rate and the supplying rate to a coater, and a method using a static mixer disclosed in N. Harnby, M. F. Edwards and A. W. Nienow (translated by K. Takahashi), *Ekitai Kongo Gijutu* (Liquid Mixing Techniques), Chapter 8, published by Nikkan Kogyo Shimbun Co., Ltd. (1989).

The surface active agent that can be applied to the invention is described in paragraph 0132 of JP-A-65021, the solvent is described in paragraph 0133 of the same publication, the support is described in paragraph 0134 of the same publication, an antistatic or electroconductive layer is described in paragraph 0135 of the same publication, a method for obtaining a color image is described in paragraph 0136 of the same publication, and a lubricating agent is described in paragraphs 0061 to 0064 of JP-A-11-84573 and paragraphs 0049 to 0062 of Japanese Patent Application No. 11-106881.

An electroconductive layer containing a metallic oxide is preferably provided in the invention. As the electroconductive material in the electroconductive layer, a metallic oxide having electroconductivity that is increased by introducing an oxygen defect or a hetero metallic defect into a metallic oxide is preferably used.

Preferred examples of the metallic oxide include ZnO, $TiO_2$ and $SnO_2$, and the addition of Al or In to ZnO, the addition of Sb, Nb, P or a halogen element to $SnO_2$, and the addition of Nb or Ta to $TiO_2$ are preferred. In particular, $SbO_2$ having Sb added thereto is preferred.

The addition amount of the hetero atom is preferably in a range of from 0.01 to 30% by mole, and more preferably in a range of from 0.1 to 10% by mole. The shape of the metallic oxide may be either a spherical shape, an acicular shape or a tabular shape, and it is preferably acicular particles having a major axis/minor axis ratio of 2.0 or more, and more preferably from 3.0 to 50, from the standpoint of endowment of electroconductivity.

The using amount of the metallic oxide is preferably in a range of from 1 to 1,000 mg/m2, more preferably in a range of from 10 to 500 mg/m2, and further preferably in a range of from 20 to 200 mg/m2. The electroconductive layer in the invention may be provided on either the emulsion layer side or the backing layer side and is preferably provided between the support and the backing layer. Specific examples of the electroconductive layer in the invention are described in JP-A-7-295146 and JP-A-11-223901.

A fluorine surface active agent is preferably used in the invention. Specific examples of the fluorine surface active agent include compounds described in JP-A-10-197985, JP-A-2000-19680 and JP-A-2000-214554. A polymer fluorine surface active agent described in JP-A-9-281636 is also preferably used. The use of a fluorine surface active agent described in Japanese Patent Application No. 2000-206560 is particularly preferred.

As a transparent support, such polyester, particularly polyethylene terephthalate, is preferably used that has been subjected to a heat treatment at a temperature range of from 130 to 185° C. to relax internal distortion remaining in the film due to biaxial stretching, so as to avoid thermal contraction caused upon thermal development. In the case of a photothermographic material for medical use, the transparent support may be colored with a blue dye (such as Dye-1 disclosed in JP-A-8-240877) or may not be colored.

Such an undercoating technique is preferably applied to the support as a water soluble polyester described in JP-A-11-84574, a styrene-butadiene copolymer described in JP-A-10-186565, and vinylidene chloride copolymers described in JP-A-2000-39684 and paragraphs 0063 to 0080 of Japanese Patent Application No. Hei 11-106881.

Those techniques can be applied to an antistatic layer and the undercoating that are described in JP-A-56-143430, JP-A-56-143431, JP-A-58-62646, JP-A-56-120519, paragraphs 0040 to 0051 of JP-A-11-84573, U.S. Pat. No. 5,575,957, and paragraphs 0078 to 0084 of JP-A-11-223898.

The photothermographic material is preferably a monosheet type (which can form an image on the photothermographic material without the use of an additional sheet, such as an image receiving sheet).

An antioxidant, a stabilizer, a plasticizer, an ultraviolet absorbent and a coating assistant may be added to the photothermographic material. Various kinds of the additives may be added to the photosensitive layer or the nonphotosensitive layer. They are described in WO98/36322, JP-A-10-186567 and JP-A-10-18568.

The photothermographic material of the invention may be formed by coating by any method. Specifically, various kinds of coating operation may be used, such as extrusion coating, slide coating, curtain coating, dip coating, knife coating, flow coating and extrusion coating using a hopper described in U.S. Pat. No. 2,681,294. Extrusion coating described in Stephen F. Kistler and Peter M. Schweizer, Liquid Film Coating, p. 399 to 536, published by Chapman & Hall, Inc. (1997), and slide coating are preferably employed, and slide coating is particularly preferably employed. Examples of the form of a slide coater used in the slide coating are disclosed in FIG. 11b.1 on page 427 of the literature. Furthermore, depending on necessity, two or more layers may be simultaneously coated according to the method described on pages 399 to 536 of the literature and the method described in U.S. Pat. No. 2,761,791 and British Patent No. 837,095.

The coating composition for the layer containing the organic silver salt in the invention is preferably a so-called thixotropic fluid. JP-A-11-52509 can be referred to for the technique.

The coating composition for the layer containing the organic silver salt preferably has a viscosity at a shearing rate of 0.1 $S^{-1}$ of from 400 to 100,000 mPa·s, and more preferably from 500 to 20,000 mPa·s. The viscosity at a shearing rate of 1,000 $S^{-1}$ is preferably from 1 to 200 mPa·s, and more preferably from 5 to 80 mpa·s.

Examples of techniques that can be applied to the photothermographic material of the invention include those described in EP803,764A1, EP883,022A1, WO98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69032, JP-A-10-186568, JP-A-10-90823, JP-A-10-171063, JP-A-10-186565, JP-A-10-186567, JP-A-10-186569 to 186572, JP-A-10-197974, JP-A-10-197982, JP-A-10-197983, JP-A-10-197985 to 197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to 133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338098, JP-A-11-338099, JP-A-11-343420 and Japanese Patent Application Nos. 2000-187298, 2000-10229, 200-47345, 2000-206642, 2000-98530, 2000-98531, 2000-112059, 2000-112060, 2000-112104, 2000-112064 and 2000-171936.

The photosensitive material of the invention is preferably packed with such a packing material that is low in oxygen permeability and/or moisture permeability in order to suppress change in photographic performance during storage before use.

The oxygen permeability at 25° C. is preferably 50 mL/atm·$m^2$·day or less, more preferably 10 mL/atm·$m^2$·day or less, and further preferably 1.0 mL/atm·$m^2$·day or less. The moisture permeability is preferably 10 g/atm·$m^2$·day or less, more preferably 5 g/atm·$m^2$·day or less, and further preferably 1 g/atm·$m^2$·day or less.

Specific examples of the packing material that is low in oxygen permeability and/or moisture permeability include packing materials described in JP-A-8-254793 and JP-A-2000-206653.

The photothermographic material of the invention may be developed by any method, and in general, a photothermographic material having been imagewise exposed is heated to accomplish development. The developing temperature is preferably from 80 to 250° C., more preferably from 100 to 140° C., and further preferably from 110 to 130° C. The developing time is preferably from 1 to 60 seconds, more preferably from 3 to 30 seconds, further preferably from 5 to 25 seconds, and particularly preferably from 7 to 15 seconds.

As the method of thermal development, any of a drum heater or a plate heater may be used, and the use of a plate heater is preferred. As a thermal developing method using a plate heater, a method described in JP-A-11-133572 is preferred, which uses such a developing apparatus that provides a visible image by contacting a photothermographic material having a latent image formed therein with a heating means in a thermal developing part, in which the heating means contains a plate heater, plural pressure rollers are arranged along one surface of the plate heater as opposed thereto, and thermal development is attained by passing the photothermographic material between the pressure rollers and the plate heater. It is preferred that the plate heater is divided into two to six stages, and the temperature of the tip end part is lowered by about from 1 to 10° C.

For example, four sets of plate heaters that can be independently controlled in temperature are provided, and the temperatures thereof are controlled to 112° C., 119° C., 121° C. and 120° C., respectively. Such a method is also described in JP-A-54-30032, by which water content and an organic solvent contained in the photothermographic material can be removed out of the system, and the support can be prevented from change in shape due to rapid heating of the photothermographic material.

The photosensitive material of the invention exerts the characteristics thereof upon exposure for a short period of time with light of a high illuminance of 1 mW/$mm^2$ or more.

Upon exposure at such a high illuminance, sufficient sensitivity can be obtained by the photothermographic material of the invention containing the silver halide having a high silver iodide content and the nonphotosensitive organic silver salt. In other words, the photosensitive material of the invention can attain high sensitivity with high illuminance exposure in comparison to low illuminance exposure.

The illuminance is more preferably from2 to 50 $mW/mm^2$, and further preferably from 10 to 50 $mW/mm^2$.

While any light source may be used as far as the conditions are satisfied, it is preferably attained by using laser light.

Examples of the laser light that can be preferably used in the invention include that emitted from a gas laser (such as $Ar^+$ and Kr), a YAG laser, a dye laser and a semiconductor laser. Furthermore, a laser and a secondary harmonic wave generating element can also be used. More preferred examples include a semiconductor laser emitting blue to ultraviolet light, and further preferred examples include a semiconductor laser having a light emission peak at a wavelength range of from 350 to 450 nm, further preferably in a wavelength range of from 390 to 430 nm. Examples of the high output semiconductor laser emitting blue to ultraviolet light include a semiconductor laser NLHV 3000E produced by Nichia Corp., and for example a laser having an output of 35 mW at a wavelength of 405 nm has been released. A high illuminance at a wavelength of from 390 to 430 nm, which is a particularly preferred wavelength for the photosensitive material of the invention, can be obtained by using the laser light.

Examples of a laser imager for medical use having an exposing part and a thermal developing part include Dry Imager FM-DP L by Fuji Medical Systems Inc.

FM-DP L is described in *Fuji Medical Review*, No. 8, p. 39 to 55, and the technique therein can be applied to a laser imager for the photothermographic material of the invention. The photothermographic material of the invention can also be applied to that for a laser imager used in the AD Network, which has been proposed by Fuji Medical Systems Inc. as a network system that complies with the DICOM Standard.

The photothermographic material of the invention forms a monochrome image with a silver image, and is preferably used as a photothermographic material for medical diagnosis, a photothermographic material for industrial photography, a photothermographic material for printing, and a photothermographic material for COM.

EXAMPLES

The invention will be specifically described with reference to the following examples, but the invention is not construed as being limited thereto.

Example 1

(Production of Photothermographic Material 1)

(Preparation Example of PET Support)

PET having an intrinsic viscosity IV of 0.66 (measured in phenol/tetrachloroethane (6/4 by volume) at 25° C.) was obtained by the ordinary method using terephthalic acid and ethylene glycol. After forming the same into pellets, it was dried at 130° C. for 4 hours and was melted at 300° C., to which the following Dye BB having the following structure was added in an amount of 0.04% by weight. It was extruded from a T die and then rapidly cooled to produce an unstretched film having such a thickness that provided a thickness after heat fixing of 175 μm.

Dye BB:

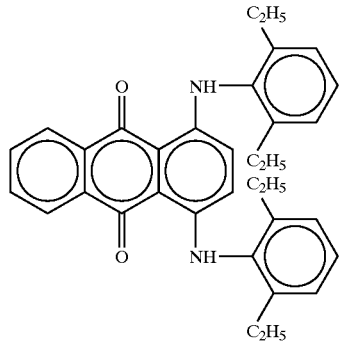

The film was stretched in the machine direction by 3.3 times using rolls having different peripheral velocities and then stretched in the transversal direction by 4.5 times using a tenter. The temperatures upon stretching were 110° C. and 130° C., respectively. Thereafter, the film was heat-fixed at 240° C. for 20 seconds, and then relaxed in the transversal direction by 4% at the same temperature. The part chucked by the tenter was slit out, and then the both ends were knurled, followed by wound at 4 $kg/cm^2$, to obtain a roll of a film having a thickness of 175 μm.

(Surface Corona Treatment)

The both surfaces of the support were treated at room temperature and 20 m/min by using a solid state corona treatment machine, 6 KVA Model produced by Piller Inc. It was found from the read values of electric current and voltage that a treatment of 0.375 $kV \cdot A \cdot min/m^2$ was applied to the support. Upon the treatment, the treating frequency was 9.6 kHz, and the gap clearance between the electrode and the dielectric roll was 1.6 mm.

(Preparation Example of Undercoated Support)

(Preparation of Coating Composition for Under Coating)

| | |
|---|---|
| Composition (1) (for undercoating on the photosensitive layer side) | |
| Pesresin A-520 (30% by weight solution) produced by Takamatsu Oil & Fat Co., Ltd. | 59 g |
| Polyethylene glycol monononylphenyl ether (average oxide number: 8.5) 10% by weight solution | 5.4 g |
| MP-1000 (polymer fine particles) (average particle diameter: 0.4 μm) produced by Soken Chemical & Engineering Co., Ltd. | 0.91 g |
| Distilled water | 935 mL |
| Composition (2) (for first layer on the backing layer side) | |
| Styrene-butadiene copolymer latex (solid content: 40% by weight, styrene/butadiene weight ratio: 68/32) | 158 g |
| 2,4-dichloro-6-hydroxy-S-triazine sodium salt (8% by weight aqueous solution) | 20 g |
| Sodium laurylbenzenesulfonate (1% by weight aqueous solution) | 10 mL |
| Distilled water | 854 mL |
| Composition (3) (for second layer on the backing surface side) | |
| $SnO_2/SbO$ (weight ratio: 9/1, average particle diameter: 0.038 μm, 17% by weight dispersion) | 84 g |
| Gelatin (10% by weight aqueous solution) | 89.2 g |
| Metolose TC-5 (2% by weight aqueous solution) produced by Shin-Etsu Chemical Co., Ltd. | 8.6 g |
| MP-1000 | 0.01 g |

-continued

| | |
|---|---|
| produced by Soken Chemical & Engineering Co., Ltd. | |
| Sodium dodecylbenzenesulfonate | |
| (1% by weight aqueous solution) | 10 mL |
| NaOH (1% by weight) | 6 mL |
| Proxel produced by Imperial Chemical Industries | 1 mL |
| Distilled water | 805 mL |

(Production of Undercoated Support)

Both the surfaces of the biaxially stretched polyethylene terephthalate support having a thickness of 175 μm were subjected to the foregoing corona treatment. The coating composition (1) for undercoating was coated on one surface thereof (photosensitive layer side) with a wire bar to a wet coated amount of 6.6 mL/m$^2$ (per one surface) and then dried at 180° C. for 5 minutes, and then the coating composition (2) for undercoating was coated on the opposite surface (backing layer side) to a wet coated amount of 5.7 mL/m$^2$ and then dried at 180° C. for 5 minutes. The coating composition (3) was further coated on the back surface (backing layer side) to a wet coated amount of 7.7 mL/m$^2$ and then dried at 180° C. for 6 minutes to produce an undercoated support.

(Preparation of Backing Layer Coating Composition)

(Preparation of Coating Composition for Antihalation Layer)

17 g of gelatin, 9.6 g of polyacrylamide, 1.5 g of monodisperse polymethyl methacrylate fine particles (average particle diameter: 8 μm, particle size standard deviation: 0.4), 0.03 g of benzoisothiazoline, 2.2 g of sodium polyethylenesulfonate, 0.1 g of a blue dye compound 1 (having a structure described later), 0.1 g of a yellow dye compound 1 (having a structure described later), and 844 mL of water were mixed to prepare a coating composition for an antihalation layer.

(Preparation of Coating Composition for Protective Layer on Back Surface)

In a container maintained at 40° C., 50 g of gelatin, 0.2 g of sodium polystyrenesulfonate, 2.4 g of N,N-ethylene-bis (vinylsulfonacetamide), 1 g of sodium t-octylphenyoxyethoxyethanesulfonate, 30 mg of benzoisothiazoline, 37 mg of a fluorine surface active agent (F-1: N-perfluorooctylsulfonyl-N-propylalanine potassium salt), 150 mg of a fluorine surface active agent (F-2: polyethylene glycol mono(N-perfluorooctylsulfonyl-N-propyl-2-amonoethyl) ether (average polymerization degree of ethyleneoxide: 15)), 64 mg of a fluorine surface active agent (F-3: having a structure described later), 32 mg of a fluorine surface active agent (F-4: having a structure described later), 10 mg of a fluorine surface active agent (F-7: having a structure described later), 5 mg of a fluorine surface active agent (F-8: having a structure described later) 8.8 g of an acrylic acid/ethyl acrylate copolymer (copolymerization ratio: 5/95 by weight), 0.6 g of Aerosol OT (produced by American Cyanamid Co., Ltd.), 1.8 g in terms of liquid paraffin of an emulsion of liquid paraffin, and 950 mg of water were mixed to obtains a coating composition for the protective layer on the back surface.

(Preparation of Silver Halide Emulsion)

(Preparation of Silver Halide Emulsion 1)

3.1 mL of 1% by weight potassium bromide solution was added to 1,420 mL of distilled water, and 3.5 mL of sulfuric acid having a concentration of 0.5 mol/L and 36.5 g of phthalated gelatin were added thereto to obtain a solution. The solution was maintained at a liquid temperature at 30° C. under stirring in a stainless steel reaction vessel, and the total amounts of a solution A, which was obtained by diluting 22.22 g of silver nitrate with distilled water to make 95.4 mL, and a solution B, which was obtained by diluting 15.3 g of potassium bromide and 0.8 g of potassium iodide with distilled water to make 97.4 mL, were added thereto over 45 seconds at constant flow rates. Thereafter, 10 mL of a 3.5% by weight hydrogen peroxide aqueous solution was added, and 10.8 mL of a 10% by weight benzoimidazole aqueous solution was further added.

Furthermore, a solution C, which was obtained by diluting 51.86 g of silver nitrate with distilled water to make 317.5 mL, and a solution D, which was obtained by diluting 44.2 g of potassium bromide and 2.2 g of potassium iodide with distilled water to make 400 mL, were prepared. The total amount of the solution C was added over 20 minutes at a constant flow rate, and the solution D was added by the controlled double jet (CDJ) method under maintaining the pAg at 8.1. The total amount of $1\times10^{-4}$ mole of iridium (III) hexachloride per 1 mole of silver was added after 10 minutes from the start of the addition of the solutions C and D. After 5 seconds from the completion of the addition of the solution C, the total amount of $3\times10^{-4}$ mole of an aqueous solution of potassium iron (II) hexacyanide per 1 mole of silver was added. The pH was adjusted to 3.8 by using sulfuric acid having a concentration of 0.5 mole/L, and stirring was terminated, followed by subjecting to sedimentation, desaltation and water washing steps.

The pH was adjusted to 5.9 by using a sodium hydroxide solution having a concentration of 1 mole/L to prepare a silver halide dispersion having pAg 8.0.

The silver halide dispersion was maintained at 38° C. under stirring, and 5 mL of a 0.34% by weight methanol solution of 1,2-benzoisothiazolin-3-one was added, followed by increasing the temperature to 47° C. 20 minutes after the temperature increase, sodium benzenethiosulfonate in the form of a methanol solution was added in an amount of $7.6\times10^{-5}$ mole per 1 mole of silver, and further 5 minutes after, a tellurium sensitizer C (having a structure described later) in the form of a methanol solution was added in an amount of $2.9\times10^{-4}$ mole per 1 mole of silver, followed by aging for 91 minutes.

1.3 mL of a 0.8% by weight methanol solution of N,N'-dihydroxy-N"-diethylmelamine was added, and further 4 minutes after, $4.8\times10^{-3}$ mole per 1 mole of silver of 5-methyl-2-mercaptobenzimidazole in the form of a methanol solution, $5.4\times10^{-3}$ mole per 1 mole of silver of 1-phenyl-2-heptyl-5-mercapto-1,3,4-triazole in the form of a methanol solution, and $8.5\times10^{-3}$ mole per 1 mole of silver of 1-(3-methylureido)-5-mercaptotetrazole sodium salt in the form of an aqueous solution were added to produce a silver halide emulsion 1.

The particles in the thus prepared silver halide emulsion were silver iodobromide particles having an average sphere-equivalent diameter of 0.040 μm and a variation coefficient of the sphere-equivalent diameter of 18%. The particle size and other parameters were obtained from an average of measurements of 1,000 particles with an electron microscope.

(Preparation of Mixed Emulsion A for Coating)

The silver halide emulsion 1 was dissolved, and a 1% by weight aqueous solution of benzothiazolium iodide was added in an amount of $7\times10^{-3}$ mole per 1 mole of silver. Water was added in such an amount that the content of the silver halide in terms of silver became 38.2 g per 1 kg of the mixed emulsion for coating, and 1-(3-methylureido)-5-mercaptotetrazole sodium salt was added in such an amount that the amount thereof became 0.34 g per 1 kg of the mixed emulsion for coating.

(Preparation of Fatty Acid Silver Salt Dispersion)

87.6 kg of behenic acid (Edenor C22-85R, a trade name, produced by Henkel Co., Ltd.), 423 L of distilled water, 49.2 L of an NaOH aqueous solution having a concentration of 5 mole/L, and 120 L of t-butyl alcohol were mixed and reacted at 75° C. for 1 hour to obtain a sodium behenate solution. Separately, 206.2 L of an aqueous solution of 40.4 kg of silver nitrate (pH 4.0) was prepared and maintained at 10° C. A reaction vessel containing 635 L of distilled water and 30 L of t-butyl alcohol was maintained at 30° C., and the total amount of the sodium behenate solution and the total amount of the silver nitrate aqueous solution were added under stirring at constant flow rates over 93 minutes and 15 seconds, and 90 minutes, respectively.

At this time, only the silver nitrate aqueous solution was added in the initial 11 minutes period of the addition of the silver nitrate aqueous solution, and then the sodium behenate solution was started to be added. In the period of 14 minutes and 15 seconds after the completion of the addition of the silver nitrate aqueous solution, only the sodium behenate solution was added. At this time, the temperature inside the reaction vessel was 30° C., and the external temperature was controlled to maintain the liquid temperature constant.

The temperature of the piping of the addition system of the sodium behenate solution was maintained by circulating warm water in the outside layer of the dual pipe, whereby the liquid temperature at the outlet of the tip end of the addition nozzle was adjusted to 75° C. The temperature of the piping of the addition system of the silver nitrate aqueous solution was maintained by circulating cold water in the outside layer of the dual pipe. The addition position of the sodium behenate solution and the addition position of the silver nitrate aqueous solution were arranged at the symmetric positions with respect to the stirring axis and were adjusted in height to prevent from contacting with the reaction liquid.

After completing the addition of the sodium behenate solution, the reaction solution was allowed to stand at that temperature for 20 minutes under stirring, and the temperature thereof was then increased to 35° C. over 30 minutes, followed by aging for 210 minutes. Immediately after completing the aging, a solid content was filtered off by centrifugal filtration, and the solid content was washed with water until the electroconductivity of the filtrate became 30 μS/cm. Thus, silver behenate was obtained. The resulting solid content was not dried and stored in the form of a wet cake.

The shape of the resulting silver behenate particles were evaluated by electron microscope observation, and thus they were squamous crystals having a=0.14 μm, b=0.4 μm and c=0.6 μm in terms of average values, an average aspect ratio of 5.2, an average sphere-equivalent diameter of 0.52 μm, and a variation coefficient of the sphere-equivalent diameter of 15%. (a, b and c were determined by the foregoing definition.)

19.3 kg of polyvinyl alcohol (PVA-217, a trade name) and water were added to a wet cake in an amount corresponding to 260 kg of a dry solid content to make a total amount 1,000 kg, and the mixture was formed into a slurry with dissolver blades, followed by subjecting to preliminary dispersion with a pipeline mixer (Model PM-10, produced by Mizuho Industrial Co., Ltd.).

The stock solution after subjecting to the preliminary dispersion was treated three times with a dispersing machine (Microfluidizer M-610, a trade name, produced by Microfluidex International Corp., using Z type interaction chamber) adjusted to have a pressure of 1,260 kg/cm2 to obtain a silver behenate dispersion. The cooling operation was set at a dispersion temperature of 18° C. by installing corrugated tube heat exchangers before and after the interaction chamber to adjust the temperature of the cooling medium.

(Preparation of Reducing Agent Dispersion)

(Preparation of Reducing Agent 2 Dispersion)

10 kg of water was added to 10 kg of the reducing agent (6,6'-di-t-butyl-4,4'-dimethyl-2,2'-butylidenediphen ol) and 16 kg of a 10% by weight aqueous solution of modified polyvinyl alcohol (Poval MP203, produced by Kuraray Co., Ltd.), followed by well mixing, to prepare a slurry.

The slurry was transported with a diaphragm pump and dispersed for 3 hours and 30 minutes in a transverse sand mill (UVM-2, produced by Imex Co., Ltd.) filled with zirconia beads having an average diameter of 0.5 mm. Thereafter, 0.2 g of benzoisothazolinone sodium salt and water were added to adjust the concentration of the reducing agent to 25% by weight to obtain a reducing agent 2 dispersion.

The reducing agent particles contained in the reducing agent dispersion had a median diameter of 0.40 μm and a maximum particle diameter of 1.5 μm or less. The resulting reducing agent dispersion was filtered with a polypropylene filter having a pore size of 3.0 μm to remove foreign matters, such as dusts, and then stored.

(Preparation of Hydrogen Bonding Compound 1 Dispersion)

10 kg of water was added to 10 kg of the hydrogen bonding compound 1 (tri (4-t-butylphenyl)phosphineoxide) and 16 kg of a 10% by weight aqueous solution of modified polyvinyl alcohol (Poval MP203, produced by Kuraray Co., Ltd.), followed by well mixing, to prepare a slurry.

The slurry was transported with a diaphragm pump and dispersed for 3 hours and 30 minutes in a transverse sand mill (UVM-2, produced by Imex Co., Ltd.) filled with zirconia beads having an average diameter of 0.5 mm. Thereafter, 0.2 g of benzoisothazolinone sodium salt and water were added to adjust the concentration of the hydrogen bonding compound to 25% by weight to obtain a hydrogen bonding compound 1 dispersion.

The hydrogen bonding compound particles contained in the hydrogen bonding compound dispersion had a median diameter of 0.35 μm and a maximum particle diameter of 1.5 μm or less. The resulting hydrogen bonding compound dispersion was filtered with a polypropylene filter having a pore size of 3.0 μm to remove foreign matters, such as dusts, and then stored.

(Preparation of Development Accelerating Agent 1 Dispersion)

10 kg of water was added to 10 kg of the development accelerating agent (having a structure described later) and 20 kg of a 10% by weight aqueous solution of modified polyvinyl alcohol (Poval MP203, produced by Kuraray Co., Ltd.), followed by well mixing, to prepare a slurry.

The slurry was transported with a diaphragm pump and dispersed for 3 hours and 30 minutes in a transverse sand mill (UVM-2, produced by Imex Co., Ltd.) filled with zirconia beads having an average diameter of 0.5 mm. Thereafter, 0.2 g of benzoisothazolinone sodium salt and water were added to adjust the concentration of the development accelerating agent to 20% by weight to obtain a development accelerating agent 1 dispersion.

The development accelerating agent particles contained in the development accelerating agent dispersion had a median diameter of 0.48 μm and a maximum particle diameter of 1.4 μm or less. The resulting development accelerating agent dispersion was filtered with a polypropylene filter having a pore size of 3.0 μm to remove foreign matters, such as dusts, and then stored.

Solid dispersions of the development accelerating agent 2, the development accelerating agent 3 and the toning agent 1 (each having structures described later) were prepared by dispersing in the same manner as in the development accelerating agent 1 to prepare 20% by weight dispersions.

(Preparation of Polyhalogen Compound)

(Preparation of Organic Polyhalogen Compound 1 Dispersion)

10 kg of the organic polyhalogen compound 1 (tribromomethanesulfonylbenzene), 10 kg of a 20% by weight aqueous solution of modified polyvinyl alcohol (Poval MP203, produced by Kuraray Co., Ltd.), 0.4 kg of a 20% by weight aqueous solution of sodium triisopropylnaphthalenesulfonate and 14 kg of water were well mixed to prepare a slurry.

The slurry was transported with a diaphragm pump and dispersed for 5 hours in a transverse sand mill (UVM-2, produced by Imex Co., Ltd.) filled with zirconia beads having an average diameter of 0.5 mm. Thereafter, 0.2 g of benzoisothazolinone sodium salt and water were added to adjust the concentration of the organic polyhalogen compound to 26% by weight to obtain a organic polyhalogen compound 1 dispersion.

The organic polyhalogen compound particles contained in the organic polyhalogen compound dispersion had a median diameter of 0.41 μm and a maximum particle diameter of 2.0 μm or less. The resulting organic polyhalogen compound dispersion was filtered with a polypropylene filter having a pore size of 10.0 μm to remove foreign matters, such as dusts, and then stored.

(Preparation of Organic Polyhalogen Compound 2 Dispersion)

10 kg of the organic polyhalogen compound 2 (N-butyl-3-tribromomethanesulfonylbenzamide), 20 kg of a 10% by weight aqueous solution of modified polyvinyl alcohol (Poval MP203, produced by Kuraray Co., Ltd.) and 0.4 kg of a 20% by weight aqueous solution of sodium triisopropylnaphthalenesulfonate were well mixed to prepare a slurry.

The slurry was transported with a diaphragm pump and dispersed for 5 hours in a transverse sand mill (UVM-2, produced by Imex Co., Ltd.) filled with zirconia beads having an average diameter of 0.5 mm. Thereafter, 0.2 g of benzoisothazolinone sodium salt and water were added to adjust the concentration of the organic polyhalogen compound to 30% by weight to obtain a organic polyhalogen compound 2 dispersion.

The organic polyhalogen compound particles contained in the organic polyhalogen compound dispersion had a median diameter of 0.40 μm and a maximum particle diameter of 1.3 μm or less. The resulting organic polyhalogen compound dispersion was filtered with a polypropylene filter having a pore size of 3.0 μm to remove foreign matters, such as dusts, and then stored.

(Preparation of Phthalazine Compound 1 Solution)

8 kg of modified polyvinyl alcohol MP203, produced by Kuraray Co., Ltd., was dissolved in 174.57 kg of water, and 3.15 kg of a 20% by weight aqueous solution of sodium triisopropylnaphthalenesulfonate and 14.28 kg of a 70% by weight aqueous solution of the phthalazine compound 1 (6-isopropylphthalazine) were added to obtain a 5% by weight solution of the phthalazine compound 1.

(Preparation of Mercapto Compound)

(Preparation of Mercapto Compound 2 Aqueous Solution)

20 g of a mercapto compound 2 (1-(3-methylureido)-5-mercaptotetrazole sodium salt) was dissolved in 980 g of water to obtain a 2.0% by weight aqueous solution.

(Preparation of Pigment 1 Dispersion)

250 g of water was added to 64 g of C.I. Pigment Blue 60 and 6.4 g of Demol N, produced by Kao Corp., followed by well mixing, to prepare a slurry. 800 g of zirconia beads having an average particle diameter of 0.5 mm were prepared and placed in a vessel along with the slurry, and they were dispersed for 25 hours in a dispersing apparatus (1/4G sand grinder mill, produced by Imex Co., Ltd.). The concentration of the pigment was adjusted to 5% by weight by adding water to obtain a pigment 1 dispersion. The average particle diameter of the pigment particles contained in the pigment dispersion was 0.21 μm.

(Preparation of SBR Latex Liquid)

The SBR latex was prepared in the following manner.

287 g of distilled water, 7.73 g of a surface active agent (Pionin A-43-S, produced by Takemoto Oil and Fat Co., Ltd., solid content: 48.5%), 14.06 mL of 1 mol/L NaOH solution, 0.15 g of tetrasodium ethylenediamine tetraacetate, 255 g of styrene, 11.25 g of acrylic acid and 3.0 g of tert-dodecylmercaptane were placed in a polymerization vessel of a gas monomer reaction apparatus (Model TAS-2J, produced by Taiatsu Techno Corp.), and the reaction vessel was sealed and stirred at a stirring rate of 200 rpm. The vessel was evacuated with a vacuum pump and replaced several times with nitrogen gas, and then 108.75 g of 1,3-butadiene was pressed thereinto, followed by increasing the interior temperature to 60° C. A liquid obtained by dissolving 1.875 g of ammonium persulfate in 50 mL of water was added thereto, followed by stirring for 5 hours. The temperature was then increased to 90° C., followed by stirring for 3 hours, and after completing the reaction, the temperature was lowered to room temperature. 1 mole/L NaOH and 1 mole/L NH4OH were added to make a ratio of $Na^+$ ion/$NH4^+$ ion of 1/5.3 (by mole) to adjust the pH to 8.4. Thereafter, the mixture was filtered with a polypropylene filter having a pore size of 1.0 μm to remove foreign matters, such as dusts, and then stored, so as to obtain 774.7 g of SBR latex. The measurement of a halogen ion with ion chromatography revealed that the chloride ion concentration was 3 ppm. The concentration of the chelating agent measured by high performance liquid chromatography was 145 ppm.

The latex had an average particle diameter of 90 nm, a glass transition temperature Tg of 17° C., a solid content of 44% by weight, an equilibrium water content at 25° C. and 60% RH of 0.6% by weight, an ionic conductivity of 4.80 mS/cm (the measurement of the ionic conductivity was carried out by using a conductivity meter CM-30S, produced by Toa Electronics Ltd. for the latex stock liquid (44% by weight) at 25° C.), and pH 8.4.

SBR latex having a different Tg was prepared in the similar manner with appropriate variation of the ratio of styrene and butadiene.

(Preparation of Coating Composition for Emulsion Layer (Photosensitive Layer) 1)

The components obtained in the foregoing, 1,000 g of the fatty acid silver salt dispersion, 276 mL of water, 3.2 g of the organic polyhalogen compound 1 dispersion, 8.7 g of the organic polyhalogen 2 dispersion, 173 g of the phthalazine compound 1 dispersion, 1,082 g of the SBR latex (Tg: 17° C.), 155 g of the reducing agent 2 dispersion, 55 g of the hydrogen bonding compound 1 dispersion, 1 g of the development accelerating agent 1 dispersion, 2 g of the development accelerating agent 2 dispersion, 3 g of the development accelerating agent 3 dispersion, 2 g of the toning agent 1 dispersion, and 6 mL of the mercapto compound 2 aqueous solution were added in this order, and 117 g of the silver halide mixed emulsion was added immediately before coating, followed by well mixing, to obtain a coating composition for an emulsion layer, which was directly transported to a coating die for coating.

The coating composition for an emulsion layer had a viscosity measured with a B-type viscometer of Tokyo Keiki of 40 mPa·s at 40° C. (No. 1 rotor at 60 rpm).

The viscosity of the coating composition measured with RFS Fluid Spectrometer produced by Rheometrics Far East Co., Ltd. was 530, 144, 96, 51 and 28 mPa·s at a shearing rate of 0.1, 1, 10, 100 and 1,000 1/sec, respectively.

The zirconium amount in the coating composition was 0.25 mg per 1 g of silver.

(Preparation of Coating Composition for Intermediate Layer on Emulsion Layer Side)

To 1,000 g of polyvinyl alcohol PVA-205 (produced by Kuraray Co., Ltd.), 272 g of a 5% by weight dispersion of a pigment, 4,200 mL of a 19% by weight liquid of latex of a methyl methacrylate/styrene/butyl acrylate/hydroxyethyl acrylate/acrylic acid copolymer (copolymerization ratio: 64/9/20/5/2), 27 mL of a 5% by weight aqueous solution of Aerozol OT (produced by American Cyanamid Co., Ltd.) and 135 mL of a 20% by weight aqueous solution of diammonium phthalate, water was added to make a total amount of 10,000 g, and the pH was adjusted to 7.5 with NaOH, so as to obtain a coating composition for an intermediate layer, which was transported to a coating die to make 9.1 mL/m$^2$.

The coating composition had a viscosity measured with a B-type viscometer of Tokyo Keiki of 58 mPa·s at 40° C. (No. 1 rotor at 60 rpm).

(Preparation of Coating Composition for First Layer of Protective Layer on Emulsion Layer Side)

64 g of inert gelatin was dissolved in water, and 80 g of a 27.5% by weight liquid of latex of a methyl methacrylate/styrene/butyl acrylate/hydroxyethyl acrylate/acrylic acid copolymer (copolymerization ratio: 64/9/20/5/2), 23 mL of a 10% by weight methanol solution of phthalic acid, 23 mL of a 10% by weight aqueous solution of 4-methylphthalic acid, 28 mL of sulfuric acid having a concentration of 0.5 mole/L, 5 mL of a 5% by weight aqueous solution of Aerozol OT (produced by American Cyanamid Co., Ltd.), 0.5 g of phenoxyethanol and 0.1 g of benzoisothiazoline were added thereto. Water was added to make a total amount of 750 g to prepare a coating composition. 26 mL of a 4% by weight solution of chromium alum was mixed by a static mixer immediately before coating, and the mixture was transported to a coating die to make 18.6 mL/m$^2$.

The coating composition had a viscosity measured with a B-type viscometer of Tokyo Keiki of 20 mPa·s at 40° C. (No. 1 rotor at 60 rpm).

(Preparation of Coating Composition for Second Layer of Protective Layer on Emulsion Layer Side)

80 g of inert gelatin was dissolved in water, and 102 g of a 27.5% by weight liquid of latex of a methyl methacrylate/styrene/butyl acrylate/hydroxyethyl acrylate/acrylic acid copolymer (copolymerization ratio: 64/9/20/5/2), 3.2 mL of a 5% by weight solution of a fluorine surface active agent (F-1: N-perfluorooctylsulfonyl-N-propylalanine potassium salt), 32 mL of a 2% by weight aqueous solution of a fluorine surface active agent (F-2: polyethylene glycol mono (N-perfluorooctylsulfonyl-N-propyl-2-amonoethyl) ether (average polymerization degree of ethyleneoxide: 15)), 3 mL of a 5% by weight solution of a fluorine surface active agent (F-5 having a structure described later), 10 mL of a 2% by weight solution of a fluorine surface active agent (F-6 having a structure described later), 23 mL of a 5% by weight aqueous solution of Aerozol OT (produced by American Cyanamid Co., Ltd.), 4 g of polymethyl methacrylate fine particles (average particle diameter: 0.7 $\mu$m), 21 g of polymethyl methacrylate fine particles (average particle diameter: 4.5 $\mu$m), 1.6 g of 4-methylphthalic acid, 4.8 g of phthalic acid, 44 mL of sulfuric acid having a concentration of 0.5 mole/L and 10 mg of benzoisothiazoline were added thereto. Water was added to make a total amount of 650 g, and 445 mL of an aqueous solution containing 4% by weight of chromium alum and 0.67% by weight of phthalic acid were added immediately before coating by a static mixer, so as to obtain a coating composition for a surface protective layer, which was transported to a coating die to make 8.3 mL/m$^2$.

The coating composition had a viscosity measured with a B-type viscometer of Tokyo Keiki of 19 mPa·s at 40° C. (No. 1 rotor at 60 rpm).

(Preparation of Photothermographic Material 1)

On the back surface of the undercoated support, the antihalation layer coating composition to provide absorption of 0.3 at 504 nm and the back surface protective layer coating composition to provide a gelatin coated amount of 1.7 g/m$^2$ were simultaneously coated and dried to form a backing layer.

On the undercoating layer on the opposite side to the back surface, an emulsion layer, an intermediate layer, a first layer of a protective layer and a second layer of a protective layer were simultaneously coated in this order by the slide bead coating method to produce a sample of a photothermographic material. The temperatures of the emulsion layer and the intermediate layer were adjusted to 31° C., the temperature of the first layer of a protective layer was adjusted to 36° C., and the temperature of the second layer of a protective layer was adjusted to 37° C.

The coated amounts (in terms of g/m$^2$) of the compounds in the emulsion layer were as follows.

| | |
|---|---|
| Silver behenate | 5.55 |
| Polyhalogen compound 1 | 0.02 |
| Polyhalogen compound 2 | 0.06 |
| Phthalazine compound 1 | 0.19 |
| SBR latex | 9.67 |
| Reducing agent 2 | 0.81 |
| Hydrogen bonding compound 1 | 0.30 |
| Development accelerating agent 1 | 0.004 |
| Development accelerating agent 2 | 0.010 |
| Development accelerating agent 3 | 0.015 |
| Toning agent 1 | 0.010 |
| Mercapto compound 2 | 0.002 |
| Silver halide (in terms of silver) | 0.091 |

The coating and drying conditions were as follows.

The coating was carried out at a rate of 160 m/min with a gap between the tip end of the coating die and the support of from 0.10 to 0.30 mm, and the pressure of the decompression chamber was set at a value lower than the atmospheric pressure by 196 to 882 Pa. The support was destaticized with an ionic stream before coating.

The coating composition thus coated was cooled in the subsequent chilling zone with an air flow having a dry-bulb temperature of from 10 to 20° C., and the coated assembly was transported without contact and was dried in a helical non-contact dryer with a drying air flow having a dry-bulb temperature of from 23 to 45° C. and a wet-bulb temperature of from 15 to 21° C.

After drying, the assembly was adjusted for moisture content at 25° C. and 40 to 60% RH, and the film surface was heated to a temperature of from 70 to 90° C. After heating, the film surface was cooled to 25° C.

The thus produced photothermographic material had a matting degree in terms Beck's smoothness of 550 seconds on the photosensitive layer side and 130 seconds on the backing layer side. The measurement of the pH on the film surface on the photosensitive layer side revealed that it was 6.0.

The chemical structures of the compounds used in the example of the invention will be described below.

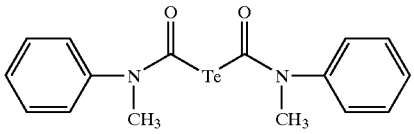

Tellurium sensitizer C

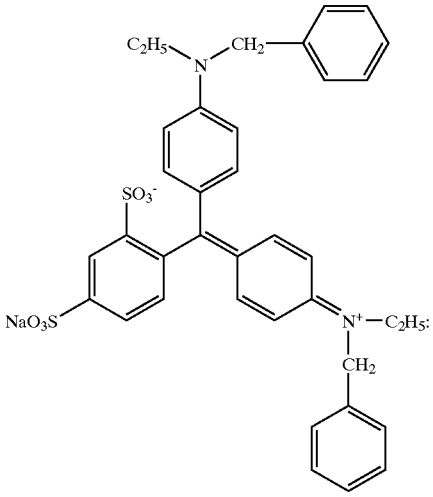

Blue Dye compound 1

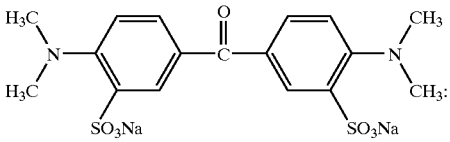

Yellow dye compound 1

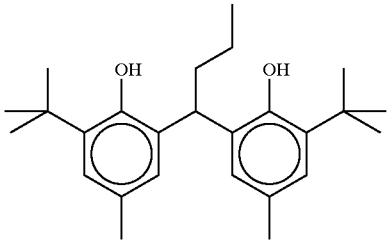

Reducing agent 2

-continued

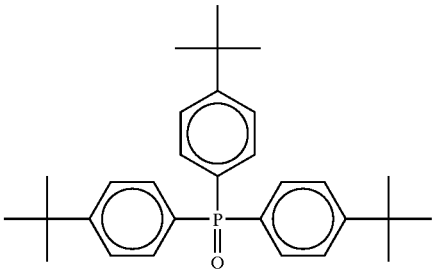

Hydrogen bonding compound 1

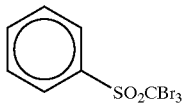

Polyhalogen compound 1

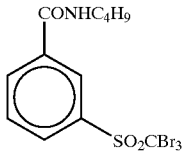

Polyhalogen compound 2

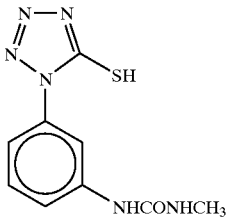

Mercapto compound 2

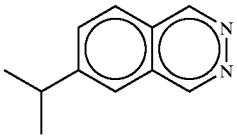

Phthalazine compound 1

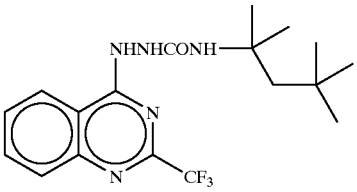

Development accelerating agent 1

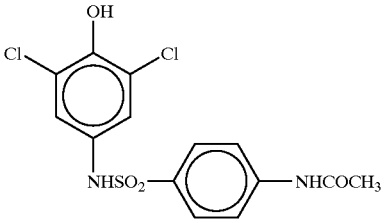

Development accelerating agent 2

-continued

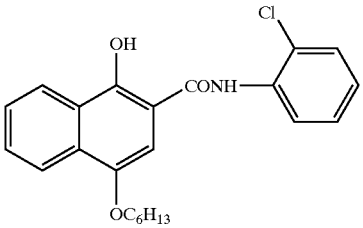

Development accelerating agent 3

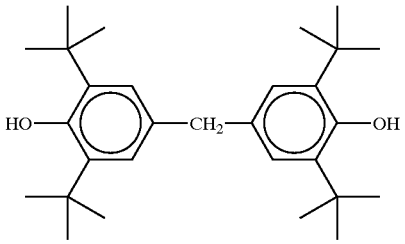

Toning agent 1

(F-1)

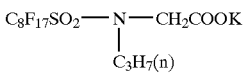

(F-2)

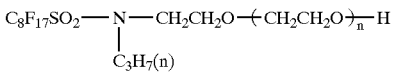

n = 15 (average)

(F-3)

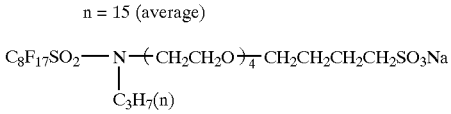

(F-4)

$C_8F_{17}SO_3K$ (F-5)

$CF_3(CF_2)nCH_2CH_2SCH_2CH_2COOLi$ mixture of compunds of n = 5 to 11

(F-6)

$CF_3(CF_2)nCH_2CH_2O(CH_2CH_2O)mH$ mixture of compunds of n = 5 to 11 and m = 5 to 15

(F-7)

$CF_3(CF_2)nCH_2CH_2SO_3Na$ mixture of compounds of n = 5 to 11

(F-8)

$C_6F_{13}CH_2CH_2SO_3Li$ (Preparation for Evaluation of Photographic Performance)

The resulting sample was cut into a half size and packed with the following packing material under an environment of 25° C. and 50%, followed by storing at ordinary temperature for two weeks.

(Packing Material)

| | |
|---|---|
| Layer structure: | PET 10 μm / PE 12 μm / aluminum 9 μm / nylon 15 μm / polyethylene containing 3% of carbon 50 μm |
| Oxygen permeability: | 0 mL/atm · $m^2$ · 25° C. · day |
| Water permeability: | 0 mL/atm · $m^2$ · 25° C. · day |

(Production of Photothermographic Material 2)

A photothermographic material 2 was produced by using the silver halide emulsion 1 used in the production of the photothermographic material 1 under the same conditions as in Example 1 except that the coated amounts of the polyhalogen compound 1 and the polyhalogen compound 2 were changed to 0.12 g/$m^2$ and 0.36 g/$m^2$, respectively.

(Production of Photothermographic Materials 3 and 4)

(Preparation of Silver Halide Emulsion 2)

3.1 mL of a 1% by weight potassium iodide solution was added to 1,421 mL of distilled water, and 3.5 mL of sulfuric acid having a concentration of 0.5 mole/L and 31.7 g of phthalated gelatin were further added to form a solution. The liquid temperature of solution was maintained at 34° C. under stirring in a stainless steel vessel. The total amount of a solution A, which was obtained by diluting 74.08 g of silver nitrate with distilled water to make 649.9 mL, was added to the solution at a constant flow rate over 100 minutes, and a solution B, which was obtained by diluting 80 g of potassium iodide with distilled water to make 800 mL, was added thereto by a CDJ method while maintaining pAg at 10.0.

10 mL of a 3.5% by weight hydrogen peroxide aqueous solution and 10.8 mL of a 10% by weight aqueous solution of benzimidazole were added after 10 minutes from the start of the addition of the solutions A and B, and further 10 minutes after, the total amount of potassium hexachloroiridate (III) was added in an amount of $1\times10^{-4}$ mole per 1 mole of silver. After 5 seconds from the completion of the addition of the solution A, the total amount of an aqueous solution of potassium iron (II) hexacyanide was added in an amount of $3\times10^{-4}$ mole per 1 mole of silver.

The pH was adjusted to 3.8 by using sulfuric acid having a concentration of 0.5 mole/L, and the stirring was terminated, followed by subjecting to sedimentation, desaltation and water washing steps. The pH was adjusted to 5.9 by using a sodium hydroxide solution having a concentration of 1 mole/L to prepare a silver halide dispersion having pAg 8.0. A silver halide emulsion 2 was prepared in the same manner as in the production of the photothermographic material 1 with respect to the other conditions.

The particles in the silver halide emulsion thus prepared were pure silver iodide particles having an average sphere-equivalent diameter of 0.040 μm and a variation coefficient of the sphere-equivalent diameter of 18%.

A photothermographic material 3 was produced under the same conditions as in the production of the photothermographic material 1 except for the use of the silver halide emulsion 2. A photothermographic material 4 was produced under the same conditions as in the production of the photothermographic material 2 except for the use of the silver halide emulsion 2.

(Production of Photothermographic Materials 5 to 8)

(Preparation of Silver Halide Emulsions 3 and 4)

Silver halide emulsions 3 and 4 were prepared in the same manner as in the production of the photothermographic material 3 except that the halogen composition was changed to those shown in Experiment Nos. 3 and 4 in the Table 1 below.

The particles in the silver halide emulsions thus prepared were silver iodobromide particles having an average sphere-equivalent diameter of 0.04 μm and a variation coefficient of the sphere-equivalent diameter of 18%.

A photosensitive material 5 and a photosensitive material 7 were produced in the same manner as in the production of the photothermographic material 1 except that the silver halide emulsions 3 and 4 were used. A photosensitive material 6 and a photosensitive material 8 were produced in the same manner as in the production of the photothermographic material 2 except that the silver halide emulsion 4 was used.

(Preparation of Silver Halide Emulsion 5)

A silver halide emulsion 5 was produced through the following steps.

A pure silver iodide emulsion A was produced in the same manner as in the silver halide emulsion 2 except that the solution A was a solution obtained by adding distilled water to 59.26 g of silver nitrate to make 520 mL, the total amount of which was added at a constant flow rate over 80 minutes, and the solution B was added by a CDJ method while maintaining pAg at 10.0.

1,420 mL of distilled water, the total amount of the pure silver iodide emulsion A thus prepared, 9.2 g of phthalated gelatin and 3.1 mL of a 1% by weight potassium bromide solution were mixed to form a solution, and the liquid temperature of the solution was maintained at 35° C. in a stainless steel reaction vessel. The total amount of a solution A, which was formed by diluting 14.8 g of silver nitrate with distilled water to make 260 mL, was added at a constant flow rate over 26 minutes, and a solution B, which was formed by diluting 12 g of potassium bromide with distilled water to make 300 mL, was added by a CDJ method while maintaining pAg at 10.0.

After terminating the stirring and subjecting to sedimentation, desaltation and water washing steps, the pH was adjusted to 5.9 by using a sodium hydroxide solution having a concentration of 1 mole/L to produce a silver halide dispersion. A silver halide emulsion 5 was prepared in the same manner as in the production of the photothermographic material 1 with respect to the other conditions.

The particles in the silver halide emulsion thus prepared were silver iodobromide particles having an average sphere-equivalent diameter of 0.04 μm and a variation coefficient of the sphere-equivalent diameter of 22%. They were silver halide particles, in which a silver iodobromide structure having an iodine content of 15% by mole was present through junction in the vicinity of the surface by a depth of about 4 nm from the particle surface.

A photothermographic material 9 was produced under the same conditions as in the production of the photothermographic material 1 except for the use of the silver halide emulsion 5. A photothermographic material 10 was produced under the same conditions as in the production of the photothermographic material 2 except for the use of the silver halide emulsion 5.

(Production of Photothermographic Materials 11 and 12)

(Preparation of Silver Halide Emulsion 6)

1,420 mL of distilled water, 850 g of the silver halide emulsion 2, 9.2 g of phthalated gelatin and 3.1 mL of a 1% by weight potassium bromide solution were mixed to form a solution, and the liquid temperature of the solution was maintained at 35° C. in a stainless steel reaction vessel. The total amount of a solution A, which was formed by diluting 7.4 g of silver nitrate with distilled water to make 130 mL, was added at a constant flow rate over 13 minutes, and a solution B, which was formed by diluting 6 g of potassium bromide with distilled water to make 150 mL, was added by a CDJ method while maintaining pAg at 10.0.

After terminating the stirring and subjecting to sedimentation, desaltation and water washing steps, the pH was adjusted to 5.9 by using a sodium hydroxide solution having a concentration of 1 mole/L to produce a silver halide dispersion. A silver halide emulsion 6 was prepared in the same manner as in the production of the photothermographic material 1 with respect to the other conditions.

The particles in the silver halide emulsion thus prepared were silver halide particles having an average sphere-equivalent diameter of 0.04 μm and a variation coefficient of the sphere-equivalent diameter of 19%, in which a silver iodobromide structure having an iodine content of 25% by mole was present through junction in the vicinity of the surface by a depth of about 4 nm from the particle surface.

A photothermographic material 11 was produced under the same conditions as in the production of the photothermographic material 1 except for the use of the silver halide emulsion 6. A photothermographic material 12 was produced under the same conditions as in the production of the photothermographic material 2 except for the use of the silver halide emulsion 6.

(Production of Photothermographic Materials 13 and 14)

(Preparation of Silver Halide Emulsion 7)

A silver halide emulsion 7 was obtained in the same manner as in the preparation of the silver halide emulsion 6 except that the solution B was added under the liquid temperature maintained at 50° C. by a CDJ method while maintaining the pAg at 9.4.

A photothermographic material 13 was produced under the same conditions as in the production of the photothermographic material 1 except for the use of the silver halide emulsion 7. A photo thermographic material 14 was produced under the same conditions as in the production of the photothermographic material 2 except for the use of the silver halide emulsion 7.

(Production of Photothermographic Materials 15 to 22)

(Preparation of Silver Halide Emulsions 8 to 11)

Silver halide emulsions 8 to 11 having the compositions shown in Experiment Nos. 8 to 11 in the Table 1 were prepared in the same manner as in the preparation of the silver halide emulsion 5 except that the addition amounts of the solutions A and B were changed.

The particles in the silver halide emulsion thus prepared were silver iodobromide particles having an average sphere-equivalent diameter of 0.04 μm and a variation coefficient of the sphere-equivalent diameter of 18%. They were silver halide particles, in which a silver iodobromide structure having an iodine content shown in the Table 1 was present through junction. The silver iodobromide structure was present in the vicinity of the surface by a depth of about 5 nm from the particle surface.

Photothermographic materials 15, 17, 19 and 21 were produced under the same conditions as in the production of the photothermographic material 1 except for the use of the silver halide emulsions 8 to 11. Photothermographic materials 16, 18, 20 and 22 were produced under the same conditions as in the production of the photothermographic material 2 except for the use of the silver halide emulsions 8 to 11.

(Evaluation of Photothermographic Materials 1 to 22)

The photosensitive materials 1 to 22 obtained in the foregoing were evaluated in the following manner.

(Exposure of Photosensitive Material)

The photosensitive materials obtained in Examples 1 to 8 were subjected to an exposure treatment in the following manner.

A semiconductor laser NLHV3000E produced by Nichia Corp. was installed in an exposure part of Dry Imager FM-DP L by Fuji Medical Systems Inc., and the beam diameter was narrowed down to about 100 $\mu$m. Exposure of the photosensitive material was carried out for 10—6 second while the illuminance of laser light on the surface of the photosensitive material was changed from 0 and 1 to 1,000 mW/mm$^2$. The light emission wavelength of the laser light was 405 nm.

(Development of Photosensitive Material)

The photosensitive materials thus exposed were subjected to a thermal development treatment in the following manner.

In the thermal developing part of Dry Imager FM-DP L by Fuji Medical Systems Inc., four plate heaters were set at 112° C., 115° C., 118° C. and 121° C., respectively, thermal development was carried out to make a total thermal developing time of 14 seconds by increasing the film conveying speed.

(Evaluation of Samples)

The resulting images were measured for density by a densitometer, and a characteristic curve of densities with respect to logarithm of the exposure amount was prepared. An optical density on the non-exposed part was designated as fogging, and a reciprocal of the exposure amount providing an optical density of 3.0 was designated as sensitivity, which was expressed as a relative value with the sensitivity of the photosensitive material 3 being 100.

The results are shown in the Table 1.

materials of the invention have high sensitivities with small desensitization widths due to the polyhalogen in comparison to the comparative examples.

Example 2

(Production and Evaluation of Photothermographic Materials 23 to 38)

Photosensitive materials 23 to 30 were produced in the same manner as in the production of the photothermographic materials 1 and 2 of Example 1 except that the coated amount of the phthalazine compound was changed to ratios to the silver halide as shown in the Table 2.

Photosensitive materials 31 to 38 were produced in the same manner as in the production of the photosensitive materials 17 and 18 of Example 1 except that the coated amount of the phthalazine compound was changed to ratios to the silver halide as shown in the Table 2.

The photosensitive materials and the photosensitive materials 1, 2, 17 and 18 were evaluated for photographic properties in the same manner as in Example 1. The sensitivity is expressed as a relative value with the sensitivity of the photosensitive material 17 being 100. The results are shown in the Table 2.

TABLE 1

| Experiment No. | Photosensitive material | Wavelength of exposure laser (nm) | Total silver iodide content (% by mole) | Total silver bromide content (% by mole) | Ratio of silver iodide/silver bromide in junction part of silver iodobromide | Content of junction part (% by mole) | Phthalazine compound (mole/Ag mole) | Sensitivity to polyhalogen amount: Polyhalogen amount (1) | Polyhalogen amount (2) | (1)/(2) | Note |
|---|---|---|---|---|---|---|---|---|---|---|---|
| 1 | 1, 2 | 405 | 3.5 | 96.5 | — | 0 | 1.27 | 32 | 18 | 1.78 | Comparison |
| 2 | 3, 4 | 405 | 100 | 0 | — | 0 | 1.27 | 100 | 44 | 2.27 | Comparison |
| 3 | 5, 6 | 405 | 90 | 10 | — | 0 | 1.27 | 102 | 44 | 2.32 | Comparison |
| 4 | 7, 8 | 405 | 95 | 5 | — | 0 | 1.27 | 101 | 44 | 2.30 | Comparison |
| 5 | 9, 10 | 405 | 80 | 20 | 15/85 | 17.1 | 1.27 | 108 | 53 | 2.03 | Invention |
| 6 | 11, 12 | 405 | 90 | 10 | 25/75 | 8 | 1.27 | 113 | 60 | 1.88 | Invention |
| 7 | 13, 14 | 405 | 90 | 10 | 15/85 | 8 | 1.27 | 115 | 60 | 1.92 | Invention |
| 8 | 15, 16 | 405 | 95 | 5 | 25/75 | 4 | 1.27 | 120 | 70 | 1.71 | Invention |
| 9 | 17, 18 | 405 | 95 | 5 | 15/85 | 4 | 1.27 | 121 | 72 | 1.68 | Invention |
| 10 | 19, 20 | 405 | 98 | 2 | 25/75 | 2 | 1.27 | 118 | 63 | 1.87 | Invention |
| 11 | 21, 22 | 405 | 98 | 2 | 15/85 | 2 | 1.27 | 117 | 64 | 1.83 | Invention |

In the Table 1, the symbol "-" means the fact that no silver iodobromide junction part is present. The polyhalogen amounts (1) and (2) mean that the coated amount of the polyhalogen compound corresponds to the coated amount of the photothermographic materials 1 and 2. These definitions are the same as in the Tables 2 and 3 below.

In the case where the ratio of the sensitivities for the polyhalogen amount (1) and the polyhalogen amount (2) is closer to 1, the desensitization width due to the polyhalogen is smaller. It is clear from the Table 1 that the photosensitive

TABLE 2

| Experiment No. | Photosensitive material | Wavelength of exposure laser (nm) | Total silver iodide content (% by mole) | Total silver bromide content (% by mole) | Ratio of silver iodide/silver bromide in junction part of silver iodobromide | Content of junction part (% by mole) | Phthalazine compound (mole/Ag mole) | Sensitivity to polyhalogen amount: Polyhalogen amount (1) | Polyhalogen amount (2) | (1)/(2) | Note |
|---|---|---|---|---|---|---|---|---|---|---|---|
| 10 | 23, 24 | 405 | 3.5 | 96.5 | — | 0 | 0.13 | 15 | 7 | 2.14 | Comparison |
| 11 | 25, 26 | 405 | 3.5 | 96.5 | — | 0 | 0.25 | 18 | 10 | 1.8 | Comparison |
| 12 | 27, 28 | 405 | 3.5 | 96.5 | — | 0 | 0.64 | 22 | 12 | 1.83 | Comparison |
| 13 | 1, 2 | 405 | 3.5 | 96.5 | — | 0 | 1.27 | 24 | 14 | 1.71 | Comparison |
| 14 | 29, 30 | 405 | 3.5 | 96.5 | — | 0 | 6.35 | 27 | 15 | 1.8 | Comparison |
| 15 | 31, 32 | 405 | 95 | 5 | 15/85 | 4 | 0.13 | 78 | 41 | 1.90 | Invention |
| 16 | 33, 34 | 405 | 95 | 5 | 15/85 | 4 | 0.25 | 89 | 51 | 1.75 | Invention |
| 17 | 35, 36 | 405 | 95 | 5 | 15/85 | 4 | 0.64 | 94 | 54 | 1.74 | Invention |
| 18 | 17, 18 | 405 | 95 | 5 | 15/85 | 4 | 1.27 | 100 | 60 | 1.67 | Invention |
| 19 | 27, 38 | 405 | 95 | 5 | 15/85 | 4 | 6.35 | 105 | 67 | 1.57 | Invention |

It is clear from the Table 2 that in the case of the high silver iodide emulsion having a silver iodide junction part, the desensitization width due to the polyhalogen amount is decreased by increasing the coated amount of the phthalazine compound with respect to the silver halide.

Example 3

(Evaluation under Low Illuminance of Photothermographic Materials 1 to 4, 9, 10, 13, 14, 17, 18, 21 and 22)

The photosensitive material of the invention exhibits high sensitivity with favorable characteristics particularly upon exposure at high illuminance for a short period of time.

The photosensitive material was subjected to exposure in the same manner as in Example 1 except that 1 KW tungsten light with an interference filter of 405 nm inserted. The illuminance was significantly weakened to 0 and from 0.001 to 0.1 $mW/m^2$ with a step wedge in comparison to the exposure in Example 1, and therefore, a necessary optical density was obtained to adjust the exposure time. The sensitivity was expressed as a relative value with the sensitivity of the photo sensitive material 3 being 100.

The results are shown in the Table 3 below.

TABLE 3

| Experiment No. | Photosensitive material | Wavelength of exposure laser (nm) | Total silver iodide content (% by mole) | Total silver bromide content (% by mole) | Ratio of silver iodide/silver bromide in junction part of silver iodobromide | Content of junction part (% by mole) | Phthalazine compound (mole/Ag mole) | Sensitivity to polyhalogen amount: Polyhalogen amount (1) | Polyhalogen amount (2) | (1)/(2) | Note |
|---|---|---|---|---|---|---|---|---|---|---|---|
| 20 | 1, 2 | 405 | 3.5 | 96.5 | — | 0 | 1.27 | 610 | 332 | 1.84 | Comparison |
| 25 | 3, 4 | 405 | 100 | 0 | — | 0 | 1.27 | 100 | 46 | 2.17 | Comparison |
| 21 | 9, 10 | 405 | 80 | 20 | 15/85 | 17.1 | 1.27 | 107 | 56 | 1.91 | Invention |
| 22 | 13, 14 | 405 | 90 | 10 | 15/85 | 8 | 1.27 | 114 | 61 | 1.86 | Invention |
| 23 | 17, 18 | 405 | 95 | 5 | 15/85 | 4 | 1.27 | 115 | 61 | 1.89 | Invention |
| 25 | 21, 22 | 405 | 98 | 2 | 15/85 | 2 | 1.27 | 112 | 57 | 1.96 | Invention |

It is clear from the Tables 1 and 3 that the photosensitive materials of the invention exert high sensitivity in the case where they are exposed with high illuminance light in comparison to the case where they are exposed with low illuminance light. It is understood, however, that the tendency of the desensitization width due to the polyhalogen is reproduced under the low illuminance.

Example 4

The evaluations were carried out in the same manner as in Example 1 except that laser light having a light emission wavelength of 395 nm. The photosensitive materials of the invention provided the same favorable results.

According to the invention, an excellent photothermographic material having high sensitivity with a small desensitization width due to the polyhalogen amount can be provided even though it is a silver halide photosensitive material having a high silver iodide content, and a process for forming an image using the same can also be provided.

This application is based on Japanese Patent application JP 2002-122270, filed Apr. 24, 2002, the entire content of which is hereby incorporated by reference, the same as if set forth at length.

What is claimed is:

1. A photothermographic material comprising:

a support; and a photosensitive silver halide, a nonphotosensitive organic silver salt, a reducing agent, an organic polyhalogen compound and a binder, wherein the photosensitive silver halide comprises 90% by mole or more of a silver iodide and has a silver iodobromide structure having an average silver iodide content of 35% by mole or less in vicinity of a surface thereof.

2. The photothermographic material according to claim 1, which further comprises a compound represented by the following formula (1) in an amount of 0.2 mole or more per 1 mole of the photosensitive silver halide in a same side as the photosensitive silver halide, the side being defined by the support:

(1)

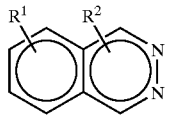

wherein $R^1$ and $R^2$ each independently represents a hydrogen atom or a group that can be substituted on a benzene ring.

3. The photothermographic material according to claim 2, wherein the amount of the compound represented by the formula (1) is 0.5 mole or more per 1 mole of the photosensitive silver halide.

4. The photothermographic material according to claim 2, wherein the amount of the compound represented by the formula (1) is 1.0 mole or more per 1 mole of the photosensitive silver halide.

5. The phototherinographic material according to claim 1, wherein the photosensitive silver halide is formed under a state where the nonphotosensitive organic silver salt is not present.

6. The photothermographic material according to claim 2, wherein the photosensitive silver halide is formed under a state where the nonphotosensitive organic silver salt is not present.

7. The photothermographic material according to claim 3, wherein the photosensitive silver halide is formed under a state where the nonphotosensitive organic silver salt is not present.

8. The photothermographic material according to claim 1, wherein the average silver iodide content of the silver iodobromide structure in the vicinit of the surface is 25% by mole or less.

9. The photothermographic material according to claim 1, wherein the average silver iodide content of the silver iodobromide structure in the vicinity of the surface is 15% by mole or less.

10. The photothermographic material according to claim 1, which further comprises a compound represented by the following formula (D):

(D)

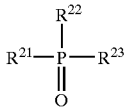

wherein $R^{21}$ to $R^{23}$ each independently represents an alkyl group, an aryl group, an alkoxy group, an aryloxy group, an amino group or a heterocyclic group, which may be unsubstituted or substituted.

11. The photothermographic material according to claim 10, which comprises the compound represented by the formula (D) in an amount of from 1to 200% by mole based on the reducing agent.

12. A process for forming an image comprising a step of exposing the photothermographic material according to claim 1 by a laser having a light emission peak at a wavelength of from 350to 450 nm.

13. The process according to claim 12, wherein the laser has a light emission peak at a wavelength of from 390 to 430 nm.

14. The process according to claim 12, wherein the laser has an exposure illuminance of 1 $mW/mm^2$ more and an exposure time of 1 second or less.

15. The process according to claim 14, wherein the exposure time is $10^{-2}$ second or less.

* * * * *